US005198059A

United States Patent [19]

Curcio et al.

[11] Patent Number: 5,198,059

[45] Date of Patent: Mar. 30, 1993

[54] METHOD AND APPARATUS FOR DECORATING ARTICLES OF NON-CIRCULAR CROSS-SECTION

[75] Inventors: Donato Curcio, Williamsville; Andrzej Aderek, Depew, both of N.Y.

[73] Assignee: United Silicone Inc., Lancaster, N.Y.

[21] Appl. No.: 715,567

[22] Filed: Jun. 14, 1991

[51] Int. Cl.[5] ..... B65C 9/00

[52] U.S. Cl. ..... 156/230; 156/358; 156/363; 156/447; 156/542

[58] Field of Search ..... 156/230, 361, 362, 363, 156/542, 552, DIG. 3, 238, 358, 359, 367, 378, 446, 447, 468

[56] References Cited

U.S. PATENT DOCUMENTS

| | | | |
|---|---|---|---|
| 4,118,264 | 10/1978 | Boettcher | 156/230 |
| 4,469,022 | 9/1984 | Meador | 101/38.1 |
| 4,502,380 | 3/1985 | Meador | 101/38.1 |
| 4,732,641 | 3/1988 | Nechay et al. | 156/542 |
| 4,889,050 | 12/1989 | Meador | 101/38.1 |

*Primary Examiner*—Jill L. Heitbrink

*Attorney, Agent, or Firm*—Hodgson, Russ, Andrews, Woods & Goodyear

[57] ABSTRACT

A method and apparatus for decorating or finishing the external surface of an article having a non-circular cross-sectional configuration, the apparatus including a roller for applying a decorating medium to the article surface, wherein during a teaching mode a constant force is applied by the roller to the article while the latter is rotated and during a subsequent decorating or finishing mode the force applied by the roller and the speed of rotation of the article are controlled according to a trajectory generated from information derived during the teaching mode to provide constant pressure and constant linear speed between the article and the decorating medium. In particular, the article is rotated about a first axis and the roller is mounted for free rotation about a second axis and is moved linearly along a path joining the two axes and into contact with the article surface. In the teaching mode, the article is rotated at a constant speed and the roller is urged along the path to apply a constant force substantially perpendicular to the surface of the article. Changes in a parameter at angular increments or intervals of the rotation of the article thereof are detected and utilized to obtain indications of the radius of the article at each of the circumferential increments or intervals. The indications of the radius are utilized to develop the above-mentioned trajectory for controlling the applied force and speed of rotation of the article during the decorating or finishing mode.

14 Claims, 16 Drawing Sheets

DEFLECTION UNDER FORCE F1

DEFLECTION UNDER FORCE F2

$$d1 = y1 - y2 < d2 = y3 - y4$$

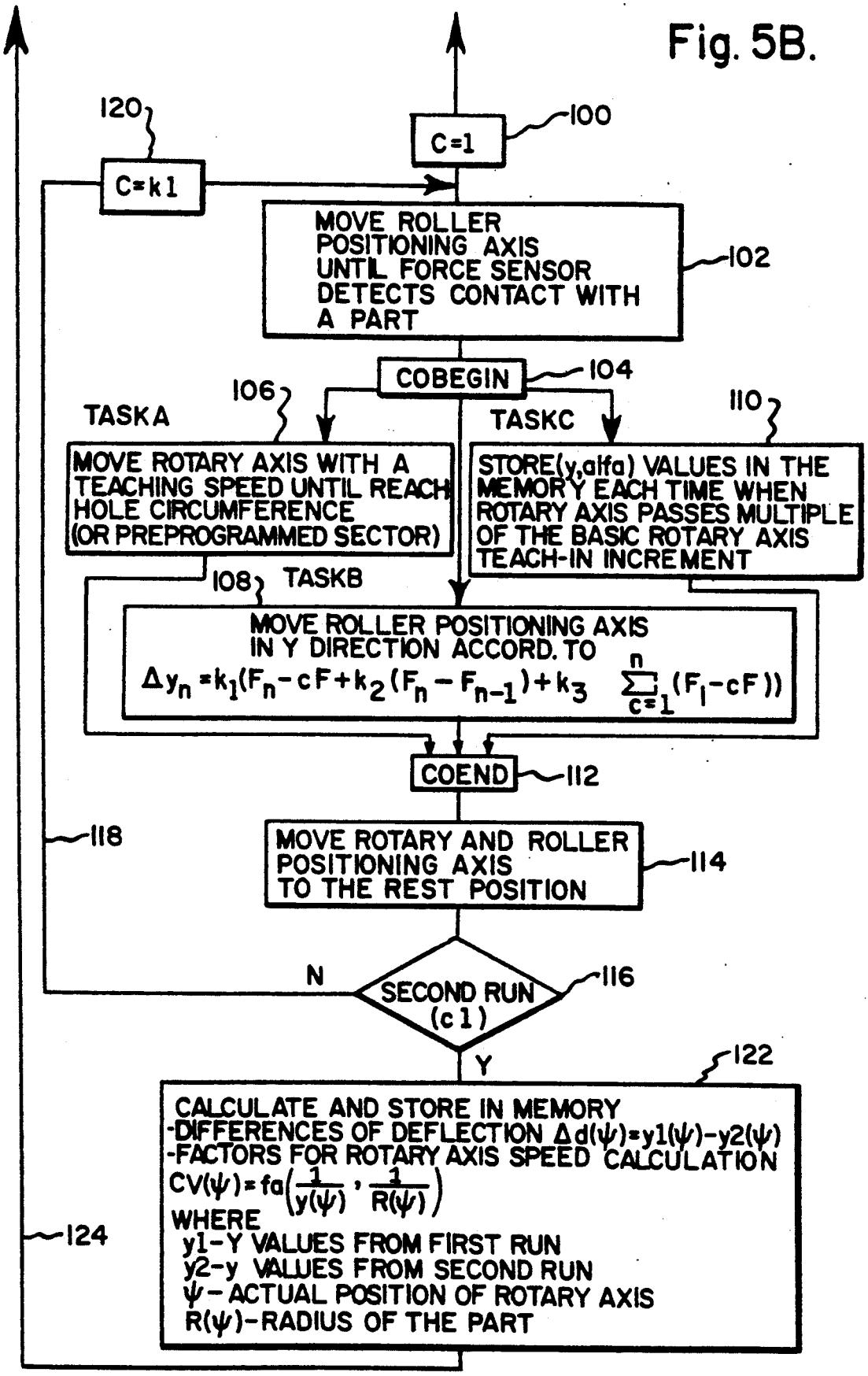
Fig. 5B.
120
C=k1
C=1
100
MOVE ROLLER POSITIONING AXIS UNTIL FORCE SENSOR DETECTS CONTACT WITH A PART
102
COBEGIN
104
106
TASKA
TASKC
110
MOVE ROTARY AXIS WITH A TEACHING SPEED UNTIL REACH HOLE CIRCUMFERENCE (OR PREPROGRAMMED SECTOR)
STORE(y,alfa) VALUES IN THE MEMORY EACH TIME WHEN ROTARY AXIS PASSES MULTIPLE OF THE BASIC ROTARY AXIS TEACH-IN INCREMENT
108
TASKB
MOVE ROLLER POSITIONING AXIS IN Y DIRECTION ACCORD. TO
$\Delta y_n = k_1(F_n - cF + k_2(F_n - F_{n-1}) + k_3 \sum_{c=1}^{n}(F_l - cF))$
COEND
112
118
MOVE ROTARY AND ROLLER POSITIONING AXIS TO THE REST POSITION
114
N
SECOND RUN (c1)
116
Y
122
CALCULATE AND STORE IN MEMORY
-DIFFERENCES OF DEFLECTION $\Delta d(\psi) = y1(\psi) - y2(\psi)$
-FACTORS FOR ROTARY AXIS SPEED CALCULATION
$CV(\psi) = fa\left(\frac{1}{y(\psi)}, \frac{1}{R(\psi)}\right)$
WHERE
y1-Y VALUES FROM FIRST RUN
y2-y VALUES FROM SECOND RUN
ψ-ACTUAL POSITION OF ROTARY AXIS
R(ψ)-RADIUS OF THE PART
124

METHOD AND APPARATUS FOR DECORATING ARTICLES OF NON-CIRCULAR CROSS-SECTION

BACKGROUND OF THE INVENTION

This invention relates to the art of decorating or finishing plastic articles, and more particularly to a new and improved method and apparatus for decorating plastic articles of non-circular cross-section.

One area of use of the present invention is in roll-on hot stamping of plastic articles, although the principles of the present invention can be variously applied. A commonly used process of finishing, i.e. decorating, of plastic parts is roll-on hot stamping, and in this process decorative pigments or metallization, plus protective and adhesive medium, are transferred from a hot stamping foil to the plastic part by hot rolling. Finish of the decoration depends upon temperature, pressure and rolling speed. Constancy of these parameters results in good quality. To achieve this, the plastic part must be moving relative to the roller with constant pressure and constant, linear speed of the point of contact, i.e. area, between the roller and the part.

The foregoing is relatively easily achievable in decorating plastic parts of circular cross-section. On the other hand, decorating parts of non-circular cross-section is relatively more difficult. The majority of existing machines for hot roll-on decoration of the outer periphery of plastic parts having non-circular cross sections are controlled by cam or numerically controlled systems. Machines based on cams have limited range and accuracy. Numerically controlled machines must be programmed for each new plastic part shape, and programming can be complicated and often must be done by the vendor of the machine.

For some configurations of numerically controlled machines, a computer controlled automatic programming method has been developed. In an illustrative prior art method, a part to be printed/stamped is moving in three directions, i.e. linear vertical, linear horizontal and rotational, under a flat horizontally positioned die. During programming, point coordinates of the trajectory are stored in a control unit memory on the basis of signals from a two-state switch indicating contact of the part with a die. This method has a number of disadvantages. In particular, it can be applied only to the flat shape of the stamping die, or to a shape which can be approximated by a flat surface, because the switch can indicate only perpendicular contact force. Also the programming method itself does not guarantee constant pressure necessary for good stamping. Furthermore, during a self programming or learning mode, the stamping machine must be equipped with special devices which replace the standard hot stamping die. Differences in position of the special programming devices and position of the die can result in additional errors. Another disadvantage is that during hot stamping of parts having a cross-sectional configuration comprising sectors of straight lines, it is necessary to apply very high force to have proper pressure when those sectors are stamped. Furthermore, the machine must have three axes of motion implying a complicated and expensive structure. Finally, this prior art approach does not react to variations in dimensions of the parts.

SUMMARY OF THE INVENTION

It is, therfore, a primary object of this invention to provide a new and improved method and apparatus for decorating or finishing plastic articles of non-circular cross-section.

It is a further object of this invention to provide such a method and apparatus which can decorate articles of any non-circular shape or cross-section.

It is a more particular object of this invention to provide such a method and apparatus which assures constant pressure and constant linear speed between the article and decorating medium during finishing thereof.

It is a further object of this invention to provide such a method and apparatus wherein during a teaching mode all characteristics and features of the shape of the article are properly recognized.

It is a more particular object of this invention to provide such a method and apparatus wherein the same component which presses the decorating medium on the article during the finishing mode is used also during the teaching mode.

It is a further object of this invention to provide such a method and apparatus which responds to and compensates for variations in dimensions of articles being decorated.

It is a further object of this invention to provide such a method and apparatus which is efficient and effective in operation.

The present invention provides a method and apparatus for decorating or finishing the external surface of an article having a non-circular cross-sectional configuration, the apparatus including a roller for applying a decorating medium to the article surface, wherein during a teaching mode a constant force is applied by the roller to the article while the latter is rotated and during a subsequent decorating or finishing mode the force applied by the roller and the speed of rotation of the article are controlled according to a trajectory generated from information derived during the teaching mode to provide constant pressure and constant linear speed between the article and the decorating medium. In particular, the article is rotated about a first axis and the roller is mounted for free rotation about a second axis and is moved linearly along a path joining the two axes and into contact with the article surface. In the teaching mode, the article is rotated at a constant speed and the roller is urged along the path to apply a constant force substantially perpendicular to the surface of the article. Changes in a parameter at angular increments or intervals of the rotation of the article thereof are detected and utilized to obtain indications of the radius of the article at each of the circumferential increments or intervals. The indications of the radius are utilized to develop the above-mentioned trajectory for controlling the applied force and speed of rotation of the article during the decorating or finishing mode. In accordance with a preferred mode of the present invention, the teaching mode includes two cycles or runs at two different levels of applied force, and the deflections of the roller and the angles of inclination of the applied force at each of the circumferential increments and for each of the two force levels are recorded. The differences in roller deflection are used to provide an indication of the article radius at the circumferential increments for use in developing the trajectory of motion of the article during the decorating mode, and the angles of inclination are used for control of the force applied by the roller to the article during that mode. In the decorating or finishing mode, the trajectory is used to control the speed of rotation of the article to reduce the contact time between the article and roller at points of sharp curvature along the article to provide constant linear speed between the article and decorating medium, and the force applied by the roller perpendicular to the surface of the article is varied according to the curvature of the article to provide constant pressure at the point of contact between article and roller. In addition, variations in dimensions of successive articles being decorated during the finishing mode are detected and appropriate correction is made to maintain proper values of applied force and resulting contact pressure.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 5A and 5B are a program flow chart illustrating operation of the method and apparatus during the teaching mode;

DETAILED DESCRIPTION OF THE ILLUSTRATED EMBODIMENT

Figure 1A:
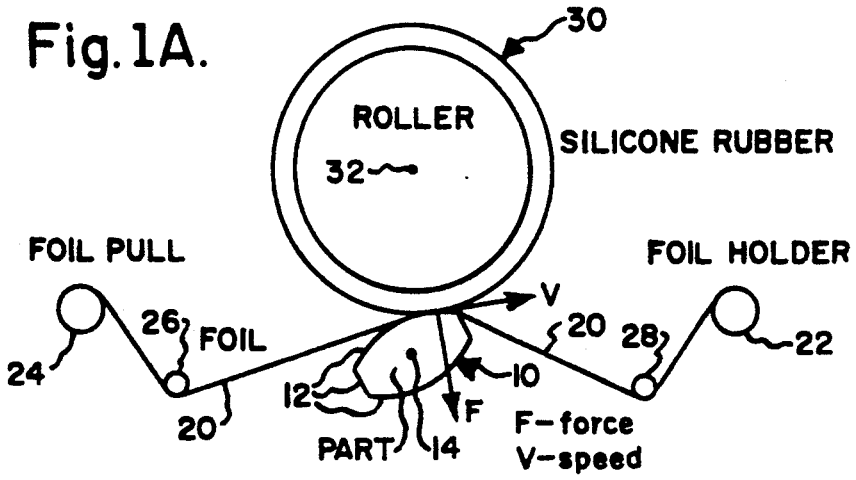
FIG. 1A is a schematic diagram illustrating a basic method and apparatus for decorating or finihsing articles by roll-on hot stamping.
Figure 1B:
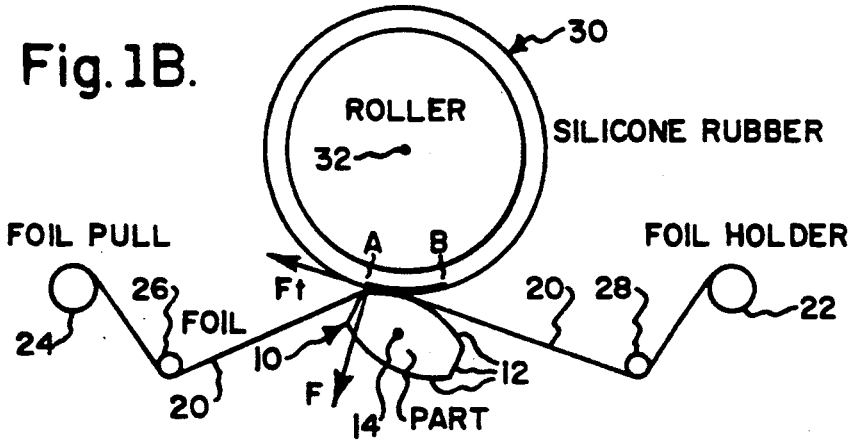
FIG. 1B is a schematic diagram illustrating the method and apparatus of FIG. 1A at another stage in the operation thereof.

Referring to FIGS. 1A and 1B there is shown two stages of operation of a basic method and apparatus for decorating or finishing articles by roll-on hot stamping. An article or part 10 having an outer surface 12 to be finished or decorated is mounted for rotation about an axis 14. Article 10 typically is of plastic material. A stamping foil 20 carries the decorative pigments or metalization together with protective and adhesive media and travels from a supply roll 22 to a take-up roll 24 in a known manner, being guidedd by the guide rollers 26,28. Foil 20 is pressed into contact with the article surface 12 by a heated roller 30 in a manner transferring the decorative pigments or metallization plus protective and adhesive media to surface 12 in a known manner. Roller 30 is mounted for rotation about an axis 32, preferably is of silicone rubber and is heated by a suitable heater apparatus (not shown) in proximity thereto.

Finish of the decoration on article surface 12 depends upon temperature, pressure and rolling speed, and constancy of these parameters results in good quality. To achieve this, article 10 must be moving relative to roller 30 with constant pressure and constant linear speed of the point of contact (area) between roller 30 and part 10. As shown in FIG. 1A, the pressure is due to a force F acting between roller 30 and article 10 in a direction perpendicular to the article surface 12. The linear speed of the point of contact (area) between roller 30 and article 10 is designated by th vector V in FIG. 1A. FIG. 1B shows the relative positions between article 10 and roller 30 after the point of contact therebetween has moved along the circular sector AB caused by counterclockwise rotation of article 10. As shown in FIG. 1B the direction of the force perpendicular to the article surface 12 has changed as indicated by the position of the force vector F. Also as shown in FIG. 1B, the force acting between article 10 and roller 30 can be decomposed into the component F acting perpendicular to the article surface 12 and the tangential component $F_T$ comprising friction force and force due to rotary inertia of roller 30. The inertia of roller 30 is due to the fact that it is accelerating and decelerating during rotation of article 10 of irregular shape. In the case of roll-on hot stamping, the force F perpendicular to article surface 12 is significantly larger than the tangential $F_T$ so that the latter can be considered negligible.

Figure 2:
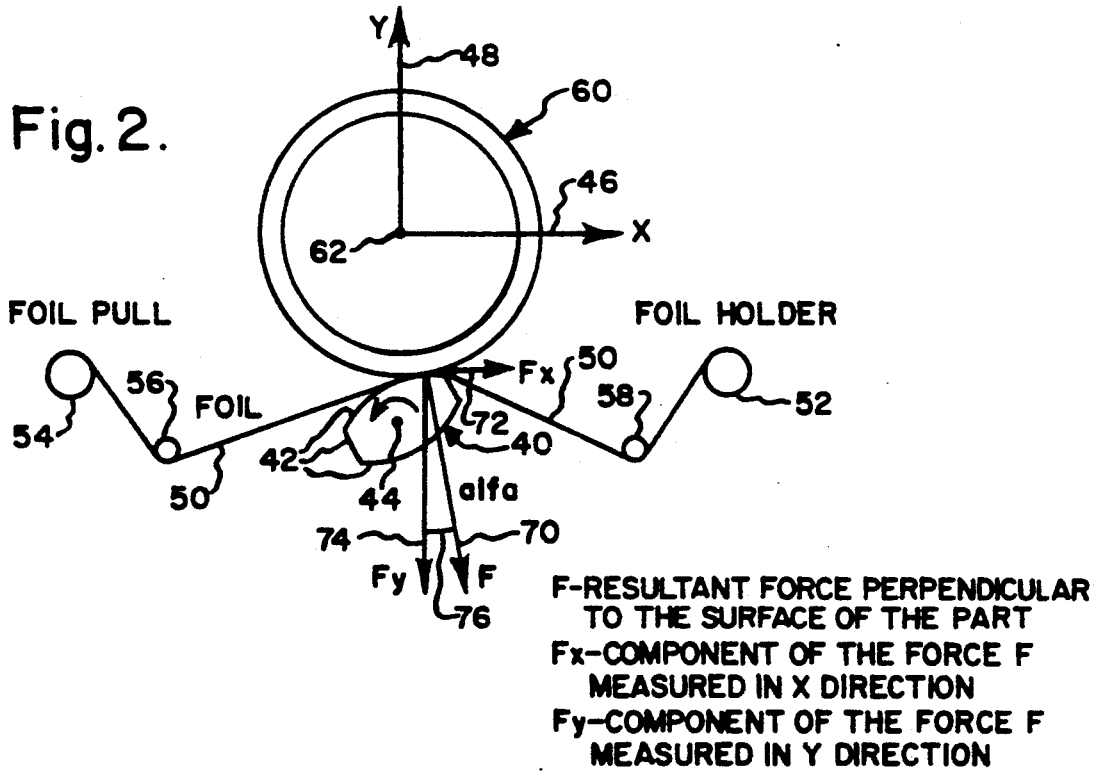
FIG. 2 is a schematic diagram illustrating the method and apparatus for decorating or finishing articles by roll-on hot stamping according to the present invention.

FIG. 2 illustrates the method and apparatus according to the present invention for decorating or finishing articles by roll-on hot stamping. An article 40 having an outer surface 42 is mounted for rotation about an axis 44. Assuming that the plane of the paper as viewed in FIG. 2 is an X-Y plane with the X and Y directions indicated by arrows 46 and 48, the rotational axis 44 of part 40 is disposed perpendicular to the X-Y plane of FIG. 2 and is fixed against any movement along that plane, i.e. fixed against any linear movement in the X or Y direction. Article 40 typically is of plastic material, and there is provided an arrangement of stamping foil 50, supply and take-up rolls 52 and 54, respectively, and guide rollers 56 and 58 in a manner similar to the arrangment shown in FIGS. 1A and 1B. Foil 50 is pressed into contact with article surface 42 by a heated roller 60 in a manner transferring the decorative pigments or metallization plus protective and adhesive media to surface 42. Roller 60 is mounted for free rotation about an axis 62 disposed perpendicular to the X-Y plane and also is mounted for linear movement along a path in the X-Y plane and joining the two axes 44 and 62, such movement being into contact with the article surface 42.

The method and apparatus of the present invention provides self-teaching in which the shape of article 40 and the trajectory of the motion of article 40 providing constant pressure and constant linear speed between roller 60 and article 40 during hot stamping are automatically recognized by the method and apparatus. During self teaching, i.e. the teaching mode, article 40 is rotated at a defined constant speed and roller 60 is urged along the path between axes 44 and 62 to apply a defined constant force in a direction substantially perpendicular to article surface 42. In particular, article 40 is rotated about axis 44 by a servo motor (not shown in FIG. 2). As illustrated previously in connection with FIG. 1B, as the point of contact between the driven article 42 and freely rotating roller 60 moves along a circular sector, i.e. sector AB in FIG. 1B, the direction of force F varies. Therefore, to determine the force F, the force $F_x$ and force $F_y$ acting on the shaft or axis 62 of roller 60 in the X and Y direction, respectively, must be determined. There is provided force/movement sensors (not shown in FIG. 2) which measure the components $F_x$ and $F_y$ as will be described in detail presently. In FIG. 2, the force F at one instant of time during relative rotation of article 40 and roller 60 is represented by arrow 70, the components $F_x$ and $F_y$ are represented by arrows 72 and 74 and the angle alpha between F and Y axis, i.e. the angle of inclination of force F, is indicated by reference numeral 76.

As article 40 is rotated at the defined constant speed, the freely rotating roller 60 is moved or driven linearly in the Y direction as viewed in FIG. 2 by an arrangement including a servo motor (not shown in FIG. 2) with feedback from the resultant force F measured by the above-mentioned force/moment sensors. This feedback control loop moves roller 60 linearly in the Y direction as viewed in FIG. 2 so that the force F is constant and equal to a set value determined by factors such as the material of article 40 and characteristics of foil 50 as will be described in further detail presently.

In accordance with one aspect of the present invention, positions of roller 60 in the Y direction and inclinations of the force F, i.e. angle alpha, corresponding to defined increments of rotary motion of article 40 are determined and recorded or stored for the entire circumference of article 40 or sector or portion thereof, depending upon how much is to be finished or decorated. The angular increments or intervals along the circumference of article 40 preferably are equal and the number is selected to provide optimum accuracy as will be described in further detail presently.

In accordance with another aspect of the present invention, the foregoing procedure is repeated at a different level of constant force F, typically at a reduced force. In particular, for proper trajectory calculation the method and apparatus of the present invention recognizes the radius, i.e. curvature, of the corners of article 40 if there are any. This is accomplished using data gathered during the two runs of the teaching mode. Calculations of the curvature of article surface 42 are based on the differences in deflections of the silicone rubber roller 60 between the two teaching mode runs.

Figure 3A:
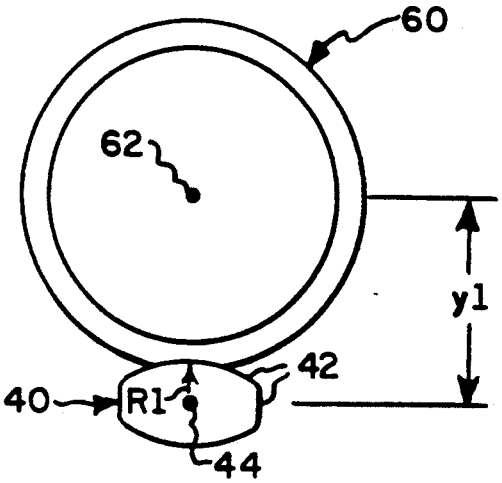
FIG. 3A–3D are schematic diagrams illustrating roller deflection for different degrees of article surface curvature and at different levels of applied force according to the present invention.

In particular, the foregoing is illustrated in FIGS. 3A-3D which show the amounts by which roller 60 is moved or deflected in the Y direction of FIG. 2 in response to both different radii or degrees of curvature of article 40 and different levels of the constant force applied by roller 60 to article 40. In particular, FIG. 3A shows the position of roller 60 in the Y direction when in contact with a portion of the article surface 42 of a relatively lower degree of curvature, i.e. wherein the radius of curvature is relatively large. Furthermore, FIG. 3A shows the position of roller 60 when the constant force applied by roller 60 to article 40 is of a first magnitude designated F1 in FIG. 3. This occurs during the first run or cycle in the teaching mode. In FIG. 3A the position of roller 60 in the Y direction is designated Y1 which is the measured distance between the respective axes 62 and 44. The radius of curvature of the portion of article surface 42 in contact with roller 60 is designated R1 in FIG. 3A. Furthermore, it is noted that the article surface 42 penetrates or extends into the body of roller 60 a certain amount as shown in FIG. 3A due to the resilient or flexible nature of the material of roller 60. Thus, in response to the application of force F1 there are two reactions: penetration of article surface 42 into the body of roller 60 and linear movement or deflection of roller 60 in the Y direction.

Figure 3C:
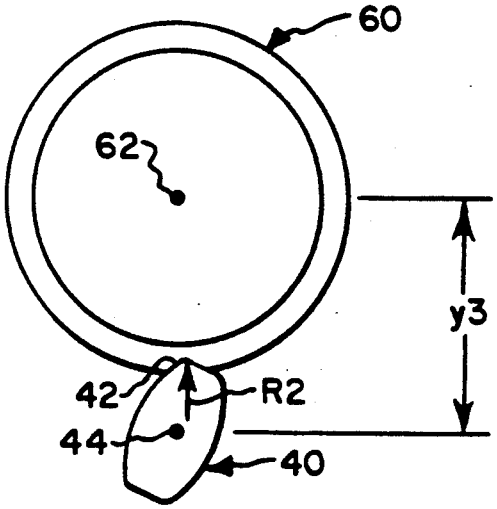
Figure 3B:
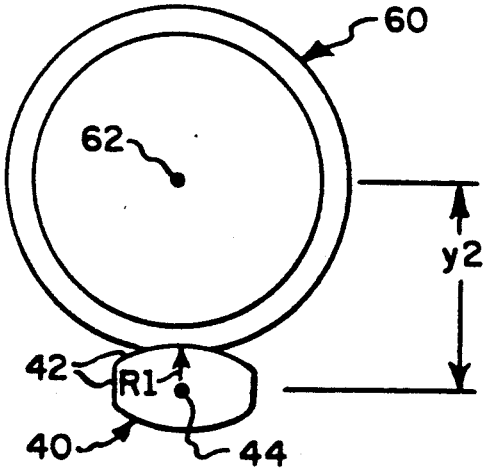

FIG. 3B shows the position of roller 60 in the Y direction when in contact with the same point or location on article surface 42 and when the applied force is of a second magnitude designated F2 in FIG. 3B. This occurs during the second run or cycle in the teaching mode. Typically, and in the present illustration, force F2 is of a lower magnitude as compared to force F1. In FIG. 3B the position of roller 60 in the Y direction is designated Y2 which is the measured distance between the respective axes 62 and 44. Because force F2 is less than force F1, distance Y2 in FIG. 3B is less than distance Y1 in FIG. 3A. The radius of curvature of the portion of article surface 42 in contact with roller 60 is R1, the same as in FIG. 3A. In addition, article surface 42 penetrates into the body of roller 60 a certain amount as shown in FIG. 3B due to the nature of the material of roller 60. Because force F2 is less than force F1, the depth or extent of penetration in FIG. 3B is less than that in FIG. 3A as can be seen.

The difference in roller deflections at the location on article surface 42 having radius of curvature R1 is the difference in roller positions in the Y direction at the two levels of applied force F1 and F2 which occur during the two runs or cycles of the teaching mode. This is represented by the relationship:

$$d1 = Y1 - Y2$$

where d1 is the difference of the deflections at the position on article surface 42 having radius of curvature R1.

FIG. 3C shows the position of roller 60 in the Y direction when in contact with a portion of the article surface 42 of a relatively higher degree of curvature, i.e. wherein the radius of curvature is relatively small. In the illustration of FIG. 3C this is at a relatively sharp corner on the article surface 42. Furthermore, FIG. 3C shows the position of roller 60 when the constant force applied by roller 60 to article 40 is of the first magnitude designated F1 in FIG. 3. As previously mentioned, this occurs during the first run or cycle in the teaching mode. In FIG. 3C the position of roller 60 in the Y direction is designated Y3 which is the measured distance between the respective axes 62 and 44. The radius of curvature of the portion of article surface 42 in contact with roller 60 is designated R2 in FIG. 3C. As in the previous instances shown in FIGS. 3A and 3B, the article surface 42 penetrates or extends into the body of roller 60 a certain amount as shown in FIG. 3C due to the resilient or flexible nature of the material of roller 60. In addition, due to the higher or sharper degree of curvature the portion of article surface 42 at R2 penetrates deeper into roller body than the portion of article surface at R1 illustrated in FIGS. 3A and 3B.

Figure 3D:
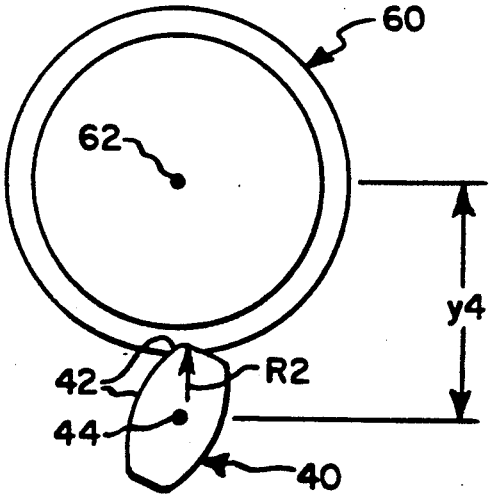

FIG. 3D shows the position of roller 60 in the Y direction when in contact with the same point or location on article surface 42 and when the applied force is of the second magnitude F2. This occurs during the second run or cycle in the teaching mode. In FIG. 3D the position of roller 60 in the Y direction is designated Y4 which is the measured distance between the respective axes 62 and 44. Because force F2 is less than force F1, distance Y4 in FIG. 3D is less than distance Y3 in FIG. 3C. The radius of curvature of the portion of article surface 42 in contact with roller 60 is R2, the same as in FIG. 3C. In addition, article surface 42 penetrates into the body of roller 60 a certain amount as shown in FIG. 3D due to the nature of the material of roller 60. Because force F2 is less than force F1, the depth or extent of penetration in FIG. 3D is less than that in FIG. 3C as can be seen.

The difference in roller deflection at the location on article surface 42 having radius of curvature R2 is the difference in roller positions in the Y direction at the two levels of applied force F1 and F2 which occur during the two runs or cycles of the teaching mode. This is represented by the relationship:

$$d2 = Y3 - Y4$$

where d2 is the difference of the deflections at the location on article surface 42 having radius of curvaure R1.

In the arrangement of the present invention the roller deflection depends on the force applied by roller 60 to article 40 and on the area of contact therebetween. The area of contact, in turn, depends on the radius of curvature. When the radius of curvature is smaller as a result of the curvature being sharper, the portion of article surface 42 penetrates deeper into roller 60 resulting in a greater deflection of roller 60. This is the case for the situation illustrated in FIGS. 3C and 3D where R2 is less than R1. In addition, the smaller radius of curvature corresponding to the higher or sharper degree of curvature of the article surface 42 is more sensitive to a difference in applied force, i.e. it results in a greater roller deflection under increased force. The foregoing is summarized by the relationship:

$$d1 = Y1 - Y2 < d2 = Y3 - Y4$$

Figure 4:
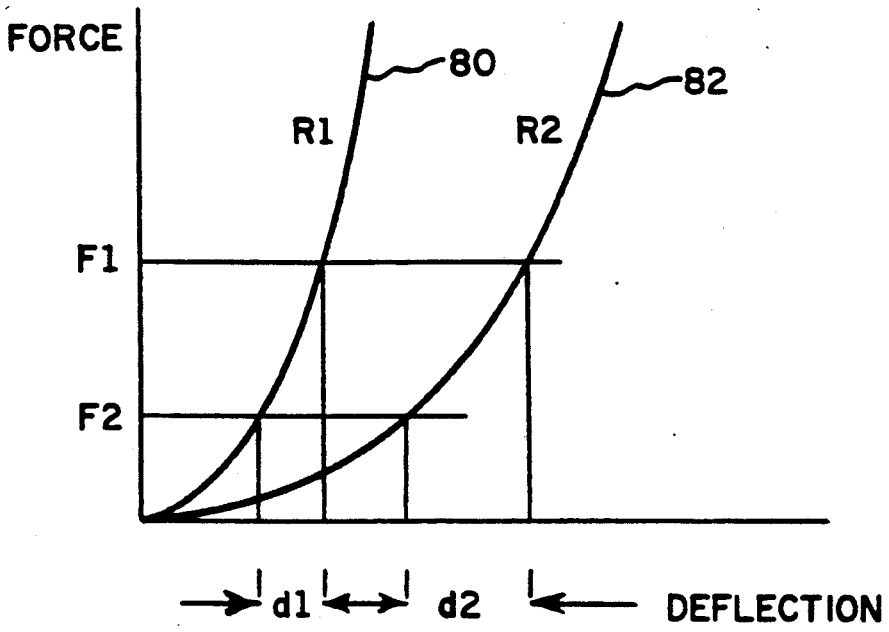
FIG. 4 is a graph of roller position as a function of applied force for two degrees of article surface curvature and which summarizes the operations shown in FIGS. 3A–3D.

Thus, in accordance with the present invention, for the different sectors of the processed article or part, i.e. at different locations along the article surface 42, differences in the roller deflection between the run or cycle with full force F1 and the run or cycle with reduced force F2 depend upon the degree or sharpness of curvature of the particular sector. Differences in the roller deflections for sectors with smaller radii are higher than differences in deflections for sectors with larger radii. For example, d2 corresponding to R2 is greater than d1 corresponding to R1 as indicated above. The foregoing is illustrated further in FIG. 4 wherein curves 70 and 72 represent roller position as a function of applied force for the two degrees of surface curvature R1 and R2, respectively.

As previously described, the objective during the decorating or finishing mode wherein heated roller 60 presses tape 50 against article surface 42 is to provide constant pressure and constant linear speed between the decorating medium 50 and the article surface 42. The teaching mode provides indications of the radius of curvature of article 40 at a number of points or locations along the article surface 42, i.e. around the circumference thereof. Using these indications of the radius of curvature, the method and apparatus of the present invention determine the magnitude of force applied by roller 60 and the speed of rotation of article 40 at each of the above-mentioned locations along surface 42 necessary to achieve constant pressure and constant linear speed between decorating medium 50 and article surface 42.

In particular, considering first the requirement of constant pressure, knowing whether the radius of curvature is large or small at any given location along article surface 42 determines the magnitude of force which must be applied by roller 60 to maintain constant pressure. A small radius of curvature results in a small area of contact between article 40 and roller 60 as illustrated in FIG. 3. Similarly a large radius of curvature results in a large area of contact. Thus, from the relationship, Force = Pressure × Area, a small radius of curvature requires a small applied force and a large radius of curvature requires a large applied force to maintain constant pressure.

Considering next the requirement of constant linear speed, the radius of curvature of article 40 at the points along surface 42 is used to determine the speed of rotation of article 40 to maintain constant linear speed. For example, to have constant linear speed between decorating medium 50 and surface 42, it is necessary to reduce the time of contact between surface 42 and roller 60 at the points of sharp curvature. Thus, it is necessary to rotate article 40 at a factor speed when sharp curvature portions of surface 42, i.e. those having a small radius of curvature, are in contact with roller 60.

Dimensions of plastic parts or articles to be decorated typically can vary within small limits, usually no more than a few hundreths of an inch, primarily due to differences in the molds from which the parts are formed. Such dimensional variations result in changes of the position of the part surface 42 relative to roller 60 which implies variation in the pressure on decorating medium 50 and surface 42 during roll-on hot stamping. The method and aparatus of the present invention overcomes this problem by means of closed loop control. In particular, after each change of stamping parameters by the operator, during the first stamping or finishing run, values of the force F applied by roller 60 are measured by the force/moment sensor and are stored in the system memory for the entire trajectory of the hot stamping motion. This applied force F is varied over the trajectory according to the curvature of the surface to provide constant pressure as previously described. During the next and subsequent stamping runs, these stored force values are used as set values in a feedback control arrangement utilizing actually measured values of the force F applied by roller 60. At each point in the trajectory along the article surface, the difference between the stored set value of force F and the actual measured value of force F provides a control action to correct the position of roller 60 in a direction so as to have the actually measured value of the force F equal to the relevant stored set value of force F. This is provided at all points along the stamping trajectory.

Figure 5A:
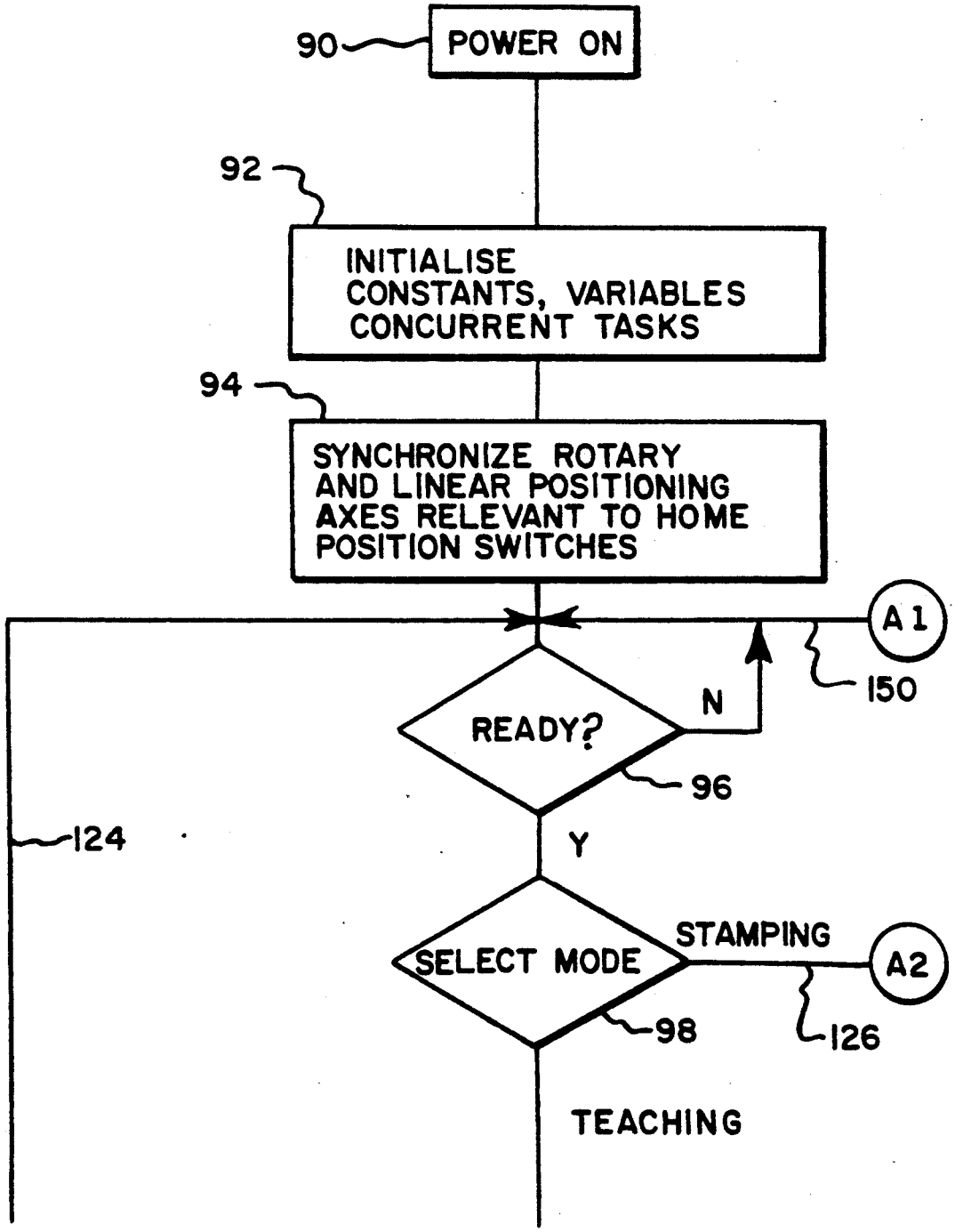
Figure 6:
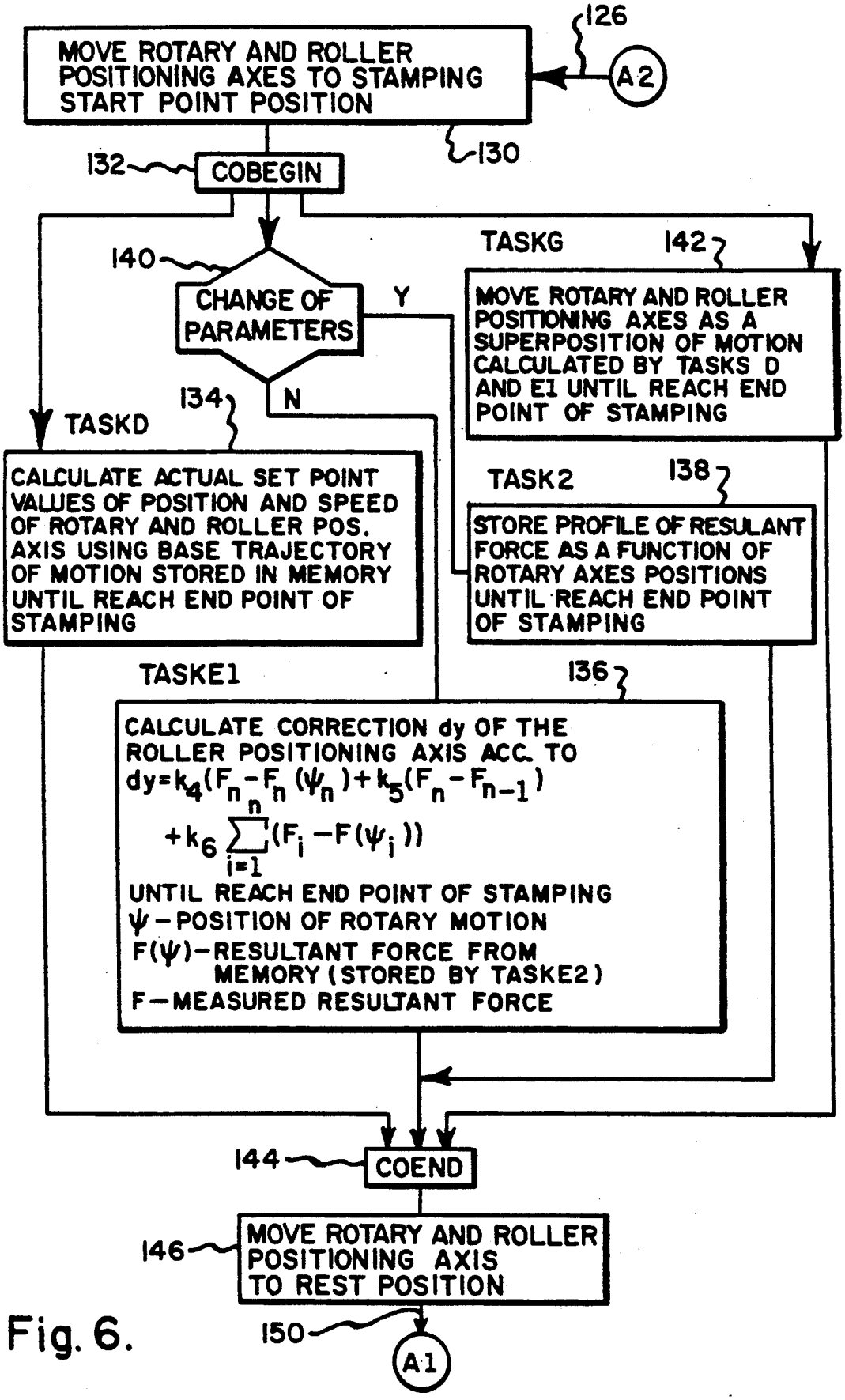
FIG. 6 is a program flow chart illustrating operation of the method and apparatus during the stamping mode.

Referring now to FIGS. 5 and 6 there is shown a program flow chart illustrating operation of a microprocessor-based system for implementing the method and apparatus of the present invention. FIG. 5 describes the teaching mode and FIG. 6 describes the stamping or decorating and finishing mode. Referring first to FIG. 5, block 90 represents the power on function and block 92 represents an initialization of constants, variables and concurrent tasks. Next, as indicated in block 94, the program synchronizes the rotary and linear positioning axes relative to home position switches. In particular, the rotary axis is axis 44 shown in FIGS. 2 and 3 about which article 40 is rotated during the teaching and stamping modes. The article is rotated by a motor as will be described in detail presently, and the home position is a particular motor shaft position detected by a switch in a manner which will be described. The linear positioning axis is roller axis 62 shown in FIGS. 2 and 3 which moves linearly along a straight line path joining the two axes 62 and 44. The home position can be at any convenient location, for example at the maximum distance roller axis 62 is spaced from article axis 44, i.e. in a vertical direction as viewed in FIGS. 2 and 3, and a switch detects the presence of roller axis 62 in this position in a manner which will be described.

Next the program proceeds first through ready and select mode decision functions represented by blocks 96 and 98, respectively, whereupon the teaching mode is selected. As indicated in block 100, at the start of the teaching mode a factord C is assigned the value 1 which indicates the first run or cycle thereof. Then, as indicated in block 102 the roller positioning axis 62 is moved by a servo motor drive arrangement, which will be described, along the afore-mentioned linear path until the force sensor associated with roller 60 detects contact between roller 60 and the surface 42 of part 40. Then the program proceeds to perform a plurality of tasks concurrently in a parallel processing mode of operation as indicated by the co-begin function block 104.

The first task, indicated in block 106, is to move the rotary axis 44 at a teaching speed for the duration of the entire circumference of article 40, i.e. the entire length of outer surface 42, or for a portion or sector thereof if that is selected. Moving the rotary axis 44 is accomplished by rotating article 40 about the fixed axis 44 by a servo motor which will be described. Furthermore, during the teaching mode article 40 is rotated at a constant angular speed, the magnitude of which is determined by the magnitude of the force applied by roller 60 to surface 42 and the accuracy of the force transducer operatively associated with roller 60. The higher the force the higher the teaching speed, and the higher the accuracy of the force transducer the higher the teaching speed. By way of example, in an illustrative method and apparatus, the time duration of each run or cycle in the teaching mode is about 2–4 minutes per article.

The next task, described in block 108, is determining the amount by which roller axis 62 is moved linearly in the Y direction, as shown in FIG. 2, to maintain constant the force applied by roller 60 to article surface 42. In other words, as $\Delta y$ increases the distance between article axis 44 and roller axis 62 increases so that the applied force decreases. Conversely, to increase the applied force $\Delta y$ is decreased. As indicated in block 108 the foregoing is determined by the relationship:

$$\Delta y_n = K_1(F_n - cF) + K_2(F_n - F_{n-1}) + K_3 \sum_{i=1}^{n} (F_i - cF)$$

where $\Delta y$ is the linear distance roller axis 62 is moved in the y direction to maintain constant force applied to article surface 42, F is a set value of force determined by the operator, $F_n$ is the resultant force determined from the $F_x$ and $F_y$ force components measured by the force transducer associated with roller axis 62, $F_{n-1}$ is resultant force value from the calculation interval immediately proceeding the instant internal in time, and C is a factor having a value of one for the first run or cycle in the teaching mode and a value greater or less than one for the second run depending upon whether a larger or smaller force is used during the second run. The above relationshp is in the nature of a Proportional - Integral - Derivative control function, and the process is continuous where the number n is an integer from zero up to the total number of calculations performed during a run or cycle of the teaching mode. The time duration of each $\Delta y$ calculation is determined by characteristics of the microprocessor and memory used, and by way-of example, in an illustrative system, each $\Delta y$ is calculated in about 20 milliseconds. Therefore, knowing the time duration of the run or cycle in the teaching mode, for example 2–4 minutes, the limit or total for n is determined. In the above relationship, the first term is a proportionality term, the second term is a derivative term and the third term is an integration term as is readily apparent to those skilled in the art. $K_1$, $K_2$ and $K_3$ are constants determined by the speed of rotation of article 40 during the teaching mode, the set value of applied force and the degree of hardness of the silicone ruber from which roller 60 is made. By way of further example, in an illustrative system, the set value of applied force F has a magnitude of about 300 pounds. This is determined by the operator of the method and apparatus, generally based on values of force recommended by the suppliers of foil 50, and is determined by the nature of the plastic material of article 40 and the width and material of foil 50.

The third task, which is performed concurrently with the two proceeding tasks is described in block 110. In particular, the function of this task is to obtain and store in the system memory, values of the roller position in the y direction and of the angle of inclination $\alpha$ of the force F applied by rotor 60 to article surface 42 at each of the defined increments of the rotary motion of article 40. By way of example, in an illustrative system, 256 increments or measurement points during one rotation of article 40 about axis 44 has been determined to provide an acceptable degree of accuracy. Therefore, the angular teaching increment or interval in degrees is obtained by dividing the circumference of the article, i.e. 360 degrees or a portion thereof if less than the total circumference is being stamped, by 256. The values of the rotor position in the y direction are obtained from a resolver associated with the output of the servo motor in the arrangement for moving rotor 60 and its axis 62 linearly which will be described in detail presently. The values of the angle of inclination $\alpha$ are obtained from the force transducer associated with rotor axis 62 which will be described in detail.

The three tasks 106, 108, and 110 end simultaneously as indicated by block 112, and this completes one run or cycle of the teaching mode. Next, article 40 is rotated to a rest position and roller 60 and its axis 62 are moved to a rest position as indicated in block 114. These rest positions may be the same or different from the home positions mentioned in connection with block 94, and they are detected in the same manner as described in connection with the home positions.

Since the factor C equals 1 during the first run or cycle of the teaching mode, the program proceeds from the decision block 116 along path 118 to block 120 where the factor C is set equal to a number K which is unequal to one. In particular, C is made less than or greater than one depending on whether the set value of force F in the second run or cycle of the teaching mode is greater or less than the set value of force F in the first run. In an illustrative method and apparatus, C is made less than one in block 120, for example C=0.4. Next, the second run or cycle of the teaching mode is initiated by moving roller 60 into contact with article surface 42 as indicated in block 120. Then the three tasks 106,108 and 110 are performed simultaneously in the second run of the teaching mode in a manner identical to that of the first run, except that the set value of force F applied by roller 60 to article surface 42 is reduced by the factor C. Upon conclusion of the second run, article 40 is rotated to the rest position and roller 60 and its axis 62 are moved to a rest position as indicated in block 114.

Since the factor C is unequal to one in the second run or cycle of the teaching mode, the program next proceeds via decision block 116 to a calculation task described in block 122. Briefly, this task calculates a base trajectory of motion, in terms of y positions and speed, as a function of the angular position of article axis 44, and this task then stores the trajectory in the system memory. In particular, as indicated in block 122, this task calculates and stores in the system memory differences of rotor deflection according to the relationship:

$$\Delta d(\phi)=y_1(\phi)-Y_2(\phi)$$

where $\Delta d(\phi)$ is the difference of deflection of the rotor 60 as a function of the angle through which the axis 44 of article 40 has been rotated, $Y_1(\phi)$ are the y values of rotor position from the first run of the teaching mode as a function of the angle of rotation of article 40 and $Y_2(\phi)$ are the Y values of rotor position from the second run of the teaching mode as a function of the angle of rotation of article 40. This task also calculates and stores in the memory factors for rotary axis, i.e. axis 44, speed calculation according to the relationship:

$$cv(\phi)=f\left(\frac{1}{y(\phi)},\frac{1}{R(\phi)}\right)$$

where $cv(\phi)$ is a factor which must be multiplied by the constant linear speed to obtain the rotary speed of article 40, $\phi$ is the actual angular position of the rotary axis 44, and $R(\phi)$ is the radius of article 40 as a function of its angular position about axis 44.

By way of further illustration, at each of the angular increments in the rotation of article 40 about axis 44, i.e. the 256 points previously mentioned by example, the distance between article axis 44 and roller axis 62 is measured, and this is done during both runs or cycles of the teaching mode. The difference in the y values for both magnitudes of applied force is a measure of the radius of curvature of the article at each increment in the angular position $\phi$. The larger the difference in y values the smaller the article radius of curvature and the sharper the degree of cuvature. The smaller the difference in y values the larger the article radius of curvature and the lower the degree of curvature. This is because of the relationship between the radius of curvature of article 40 and the area of contact with roller 60. To maintain a constant force, a larger radius of curvature means a larger area of contact and a lower pressure, and a smaller radius of curvature means a smaller area of contact and a higher pressure.

In the relationship:

$$R(\phi)=F(\Delta d(\phi))$$

where $R(\phi)$ is the radius of the article, $\phi$ is the angular position of the article about is axis and $\Delta d$ is the difference of deflection of the rotor 60 during the two runs. If the increments in $\phi$ are large enough, i.e. the 256 increments given by example, then according to Taylor's Approximation the above relationship can be approximated by:

$$R(\phi)\approx C+K\Delta d(\phi)$$

where C is a constant specified by the hardness of the silicone material of roller 60 and K is determined experimentally by investigating the relation between the radius of the part and the difference in rotor deflection of a number of parts.

The constant pressure portion of the trajectory is determined from the indications of the article radius R at each of the points or increments through the article angular position $\phi$. Since the area of contact between article surface 42 and roller 60 depends upon R, the y values corresponding to the operator set value of applied force F at each increment of $\phi$ are adjusted in accordance with the indications of R. If the indication is of a small radius R, the y value at the increment of $\phi$ is increased to reduce the pressure. If the indication is of a large radius R, the y value is not adjusted because the operator set value of force F will give the desired pressure. In addition, the average of the rotor deflection is calculated for the entire range of angular position $\phi$. If the deflection at a particular increment in $\phi$ is greater than the average, this indicates a small radius and the need for correction. If the deflection at a particular increment in $\phi$ is less than the average, no correction is needed. As a result of the foregoing, a trajectory of motion of article 40 about axis 44 is generated which will provide constant pressure between roller 60 and article surface 42 in each increment of the rotary angle $\phi$.

Figure 7:
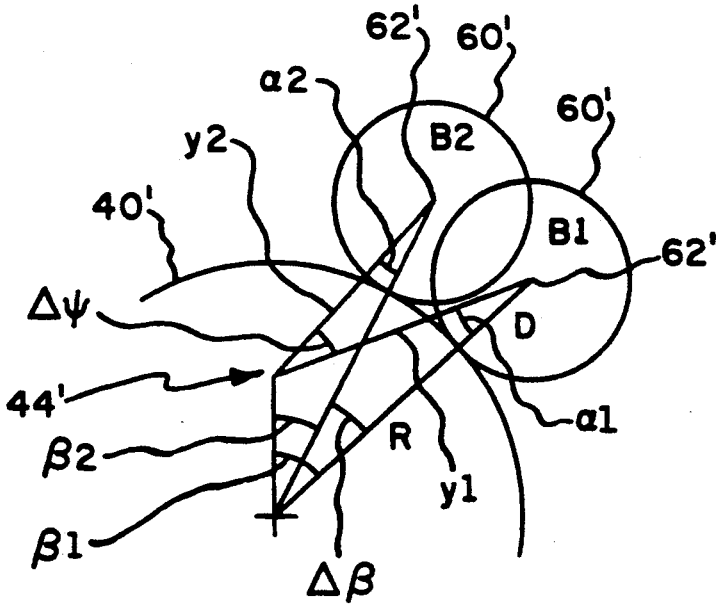
FIG. 7 is a schematic diagram illustrating an aspect of one of the tasks in the teaching mode of FIG. 5.

The other portion of the trajectory is constant linear speed. The indications of the radius R of the article at each increment in $\phi$ are used to determine what angular speed of the article in that increment is needed to obtain constant linear speed. The following is a general case example to illustrate the foregoing. Referring to FIG. 7, roller 60' has radius D and part 40' has radius of curvature R at a given increment of $\phi$. The indication of R is known from the previous operations described above. The distance between the axis of roller 60' and the axis of rotation of part 40' is indicated as y. This is a measured quantity as previously described. The angle $\beta$ is taken between OC and CB and $CB=R+D$. The angle $\alpha$ is between the force components $F_x$ and $F_y$ as previously explained and is obtained from the transducer.

In the basic time increment, i.e. period of calculation, to have a linear speed of stamping = V, the part 40' must rotate about the center of curvature of angular increment $\Delta\beta = V/R$. Knowing $OB_1 = y_1$, $CB_1 = R + D$ and the measured value of $\alpha_1$, everything about triangle $OB_1C$ can be determined. Knowing that after the basic period of calculation the angle $\beta$ should be: $\beta_2 = \beta - \Delta\beta$, and also knowing OC, $CB_2 = R + D$, everything about triangle $OB_2C$ can be determined. Therefore, the necessary rotation of part 40' in the current period of calculation, i.e. $\Delta\phi$, can be calculated.

Upon completion of task 122 the program returns via path 124 to the input of decision block 96. With the trajectory of motion for rotation of article 40 having been completed, the system is ready to operate in the stamping mode. During the teaching mode, the tape or foil 50 is not installed in the apparatus so prior to the stamping mode the operator installs tape 50 in the apparatus in operative association with reels 52,54, guide rollers 56,58 and article surface 42 in the manner shown in FIG. 2. Then the operator selects the stamping mode via an appropriate control in the apparatus and the program proceeds from decision block 98 along path 128 to the stamping mode portion of the program shown in FIG. 6.

At the onset of the stamping mode, the article 40 is rotated by the servo motor associated therewith to place rotary axis 44 in a stamping start point position and roller 60 is moved along the linear path by the servo motor arrangement associated therewith to place roller positioning axis 62 in the stamping start position. The foregoing is indicated in block 130. The stamping start position typically is the contact position established during the teaching mode indicated in block 102. Then the program proceeds to perform a plurality of tasks concurrently in a parallel processing mode of operation as indicated by the co-begin function block 132.

The first task, indicated in block 134, is to calculate actual set point values of rotor position, i.e. y values, and speed of rotation of article 40 about axis 44 using the values in the base trajectory of motion generated as described in block 122 and stored in the system memory. This is done for the duration of the stamping operation, i.e. until the end point of stamping is reached, which generally is along or around the entire circumference of article 40 but which can be for a portion thereof. Task 134 basically is an interpolation operation for the following reasons. The base trajectory calculated during the teaching mode as indicated in block 122 is done at discrete, spaced angular intervals or increments around the axis of rotation 44 of article 40. As previously described, in an illustrative system 256 points are used. During stamping, the motion is continuous around the axis 44 so it is necessary to establish by interpolation the type of path to follow from one point to the next between each of the 256 points. In accordance with a preferred mode of the present invention, the interpolation employed is second order parabolic which is well-known to those skilled in the art.

The next two tasks shown in blocks 136 and 138 perform the function needed to overcome the problem of dimensional variations among articles being stamped. As previously described, after each change of stamping parameters by the operator, during the first stamping or finishing run values of the force F applied by roller 60 are measured by the force/moment sensor and are stored in the system memory for the entire trajectory of the hot stamping motion, i.e. until the end point of stamping is reached. This is shown and described in block 138 which is under control of decision block 140. During the next and subsequent stamping runs or cycles, these stored force values are used as set values in a feedback control arrangement utilizing actually measured values of the force F applied by the roller 60. At each point in the trajectory along the article surface, the difference between the stored set value of force F and the actual measured value of force F provides a control action to correct the position of roller 60 in a direction so as to have the actually measured value of the force F equal to the relevant stored set value of force F. This is provided at all points along the stamping trajectory. The foregoing is shown and described in block 136 which is under control of decision block 140. The relationship set forth in block 136 is in the nature of a Proportional-Integral-Derivative control function and is similar to that shown and described in block 108 of the teaching mode. In this relationship, however, $F(\phi)$ is the resultant force from the memory as provided in task 138 and F is the measured resultant force. The constants $K_4$, $K_5$ and $K_6$ are determined by the speed of stamping, hardness of silicone rubber of roller 60 and the set value of the force.

Task 142 causes movement of the rotary axis 44 and the roller positioning axis 62 as a superposition of the motion calculated by tasks 134 and 136 until the end point of stamping is reached. It is the sum of the operation performed in tasks 134 and 136.

The four tasks 134,136, 138 and 142 end simultaneously as indicated by block 144 and this completes one run or cycle of the stamping mode. Article 40 is rotated and roller 60 moved linearly so that axes 44 and 62 are moved to the rest position as indicated in block 146. The program proceeds along path 150 to the input of the decision block 96 shown in FIG. 5. Normally a number of successive stamping operation will be performed on a corresponding number of additional articles, selected either by the operator or automatically. After that the teaching mode will be resumed when an article of different configuration is to be decorated or finished.

FIGS. 8–17 illustrate a preferred form of roll-on hot stamping apparatus according to the present invention. Referring first to FIGS. 8–11 the apparatus is supported in a frame 160 having foot members 162 at the four corners thereof for contacting a floor or other suitable supporting surface. An article 40'' to be finished or decorated is releasably mounted on the shaft of a part rotary drive subassembly 166 mounted in frame 160, the article axis 44'' being co-incident with the axis of the drive assembly shaft. A roller 60'' of silicone rubber material is mounted for free rotation about an axis 62'' and is housed within a heater assembly generally designated 168 for heating roller 60'' in a known manner. A roller vertical drive subassembly 172 mounted in frame 160 is operatively associated with roller 60'', axis 62'' and heater assembly 168 for moving the same toward, into contact with and away from article surface 542''. As previously described, this movement is linear and along a path joining axes 44'' and 62'' which path is vertical as viewed in FIG. 8.

The apparatus further comprises a foil pull sub-assembly generally designated 180 and a foil pay-out subassembly generally designated 182, both of which are well-known to those skilled in the art. The apparatus is shown in the stamping mode wherein foil 50'' extends between sub-assemblies 180,182 and is guided into contact with the outer surface of article 40'' by guide rollers 56'',58''. Controls for operating the apparatus are contained in a control panel 184 and a load-unload dial late structure 186 can be included if desired to facilitate loading and unloading a plurality of articles to be stamped.

Figure 8:
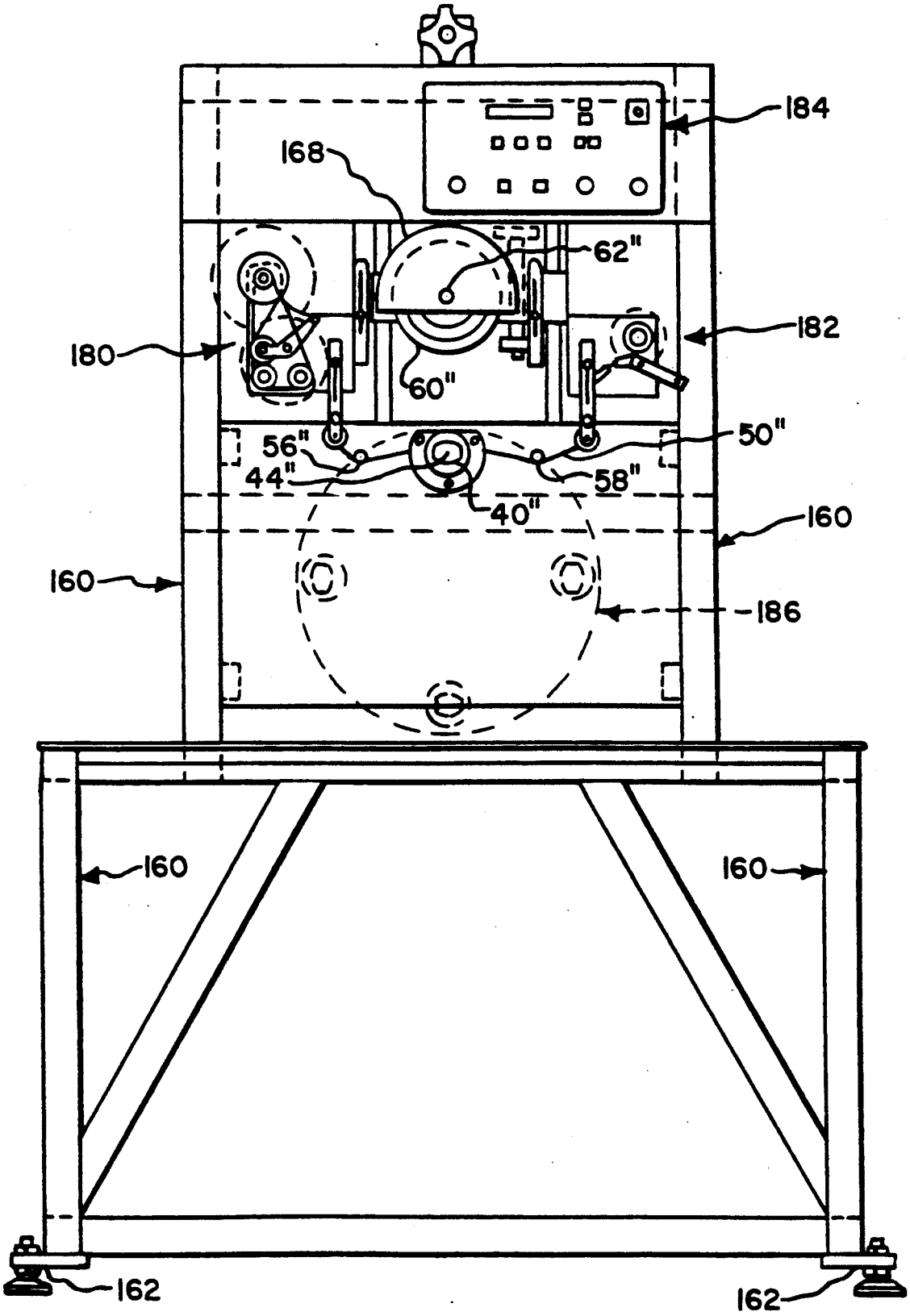
FIG. 8 is a front elevational view with parts removed of apparatus for carrying out the method of the present invention.
Figure 9:
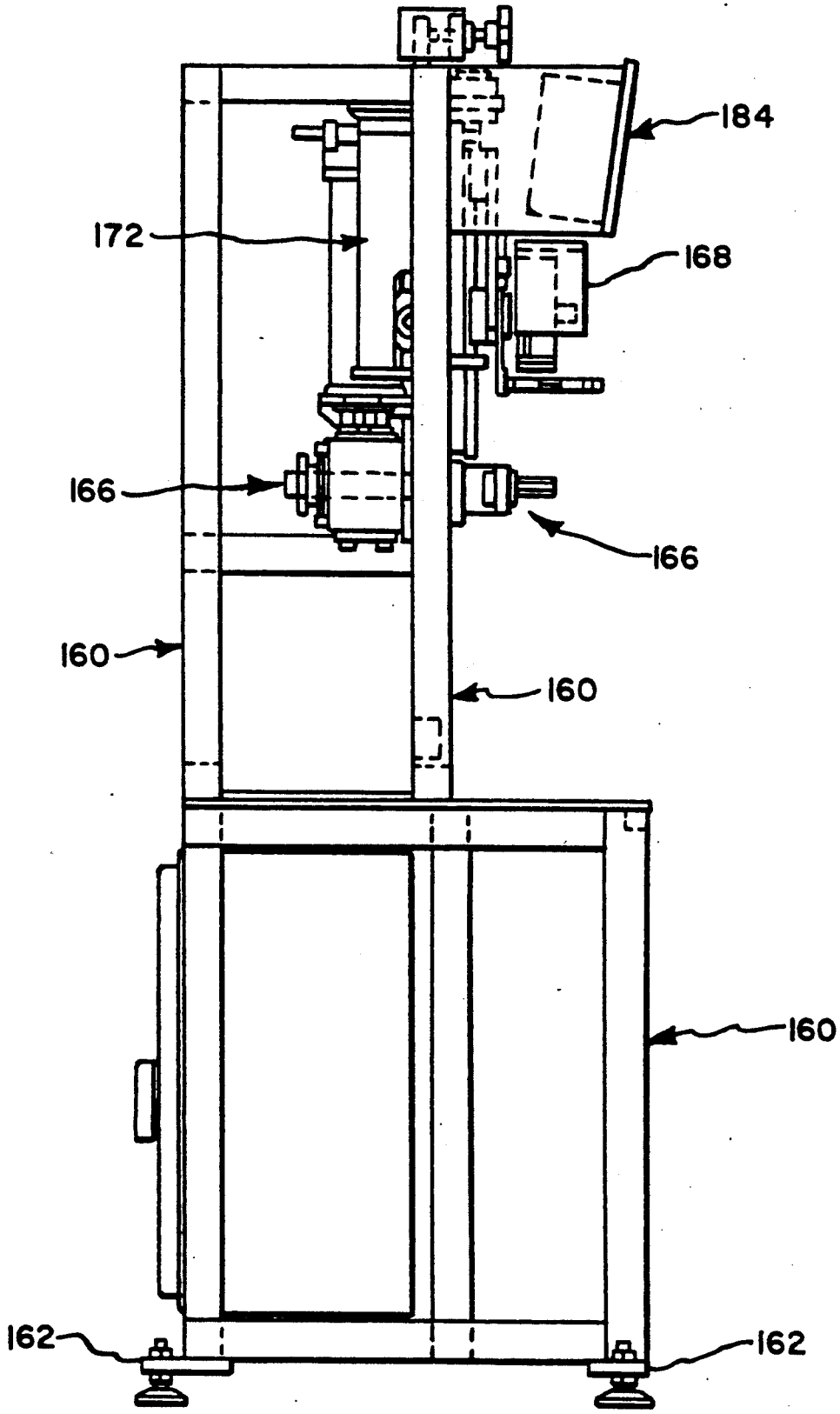
FIG. 9 is a side elevational view with parts removed of the apparatus of FIG. 8.
Figure 10:
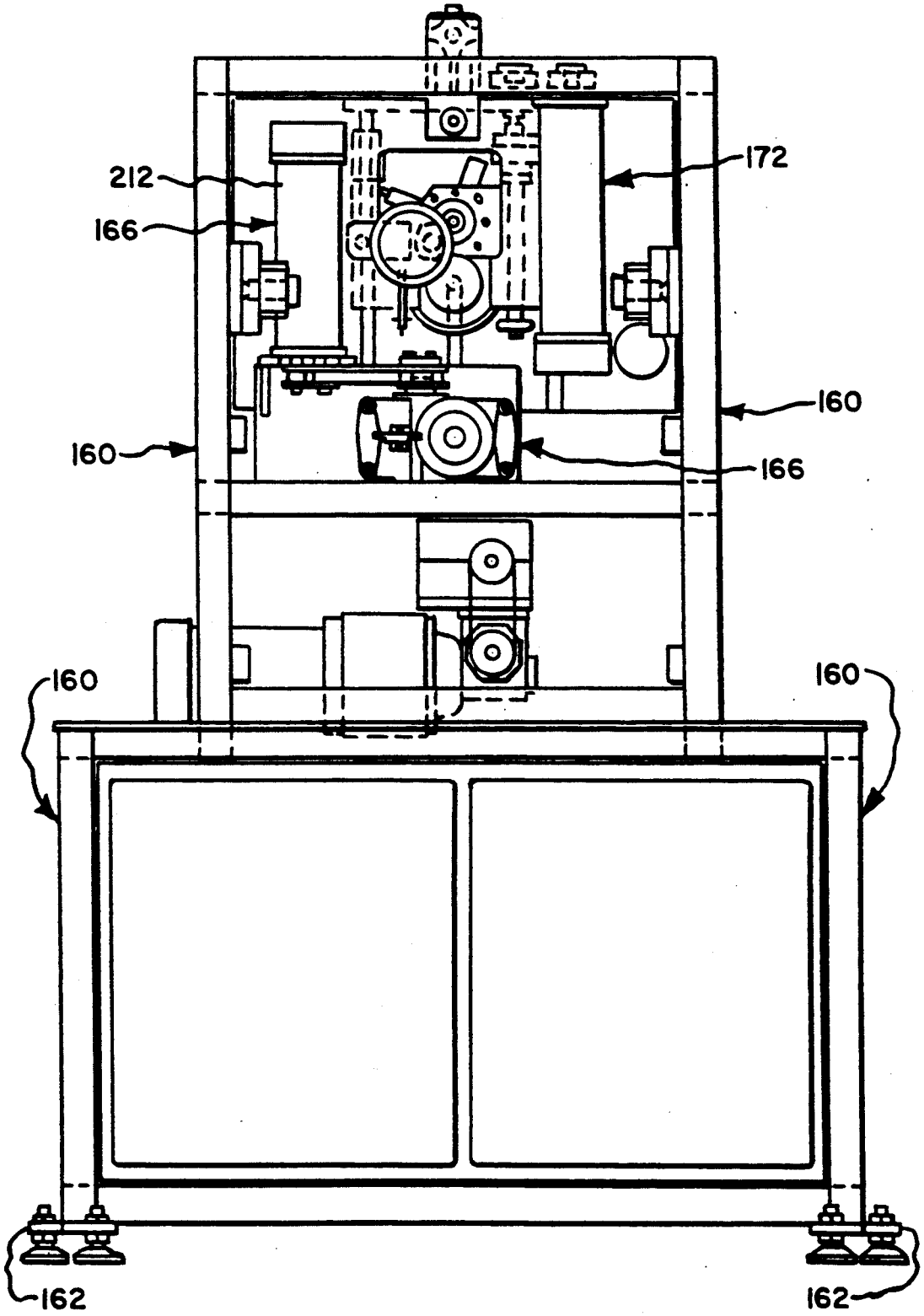
FIG. 10 is a rear elevational view with parts removed of the apparatus of FIG. 8.
Figure 11:
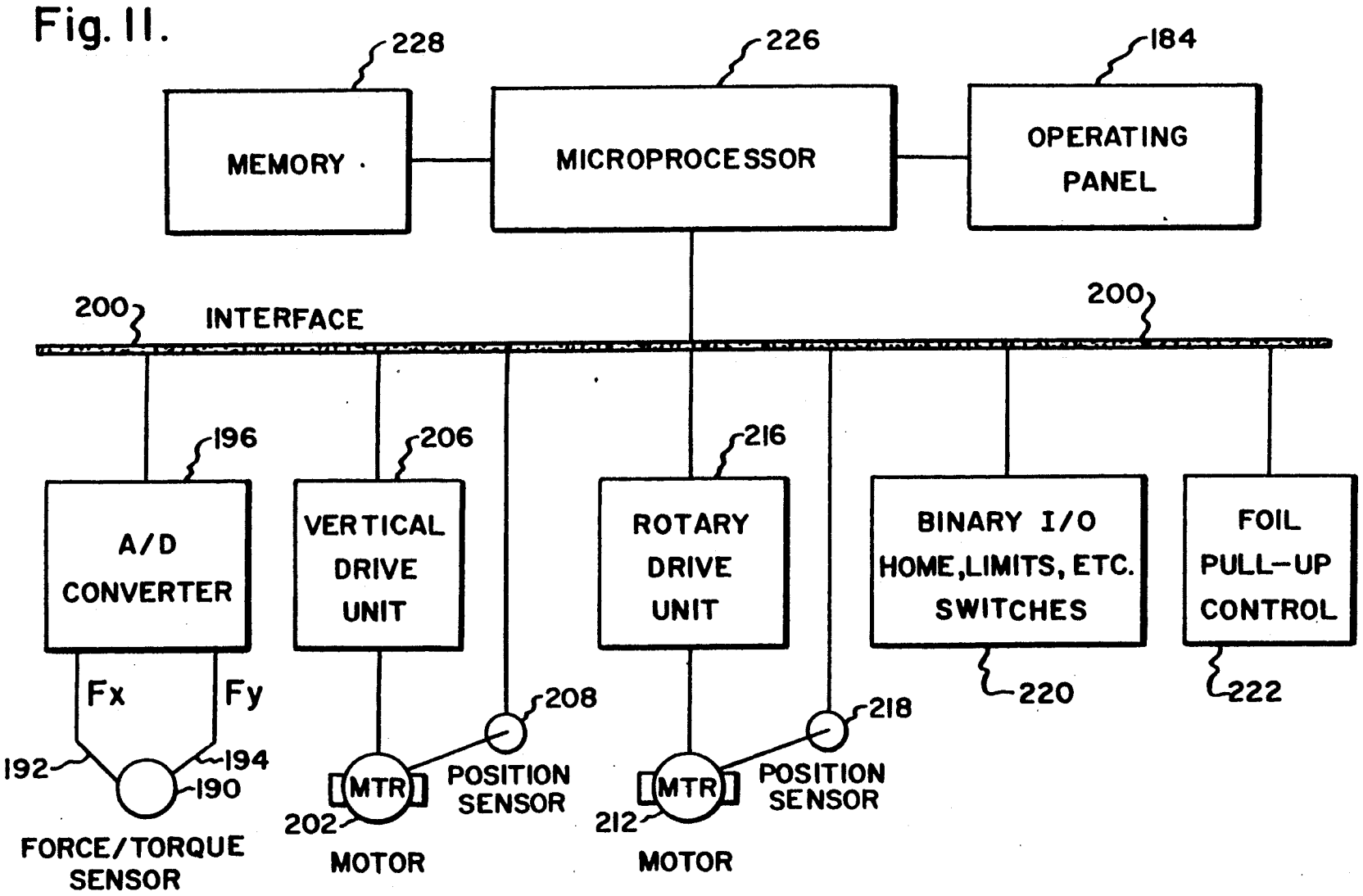
FIG. 11 is a system block diagram of the microprocessor, drives and control in the apparatus of FIGS. 6–8.

FIG. 11 illustrates the arrangement of microprocessor, control and drives for the apparatus of FIGS. 8–10. A force/torque sensor which is operatively associated with roller axis 62 is designated 190 and will be described in further detail presently. Output analog signals from sensor 190 containing information as to the force components $F_x$ and $F_y$ previously described are connected by lines 192 and 194, respectively, to inputs of an analog/digital converter 196, the output of which is connected to a system bus or interface 200. There is provided a brushless servo motor 202 for driving an arrangement for moving rotor 60'' linearly toward and away from article 40'' as previously described. The arrangement includes a ball screw driven by motor 202 and engaging a structure carrying rotor 60'' which will be described in detail presently. A control or drive unit 206 has an input connected to interface 200 and an output connected in controlling relation to motor 202. A position sensor or resolver 208 is mechanically connected to the output shaft of motor 202 and provides electrical output signals to bus 200. These signals contain information as to the linear position of rotor axis 62'', i.e. the y values mentioned above. There is also provided another brushless servo motor 212 for rotating article 40''. The structure associated with motor 212 will be described. A control or drive unit 216 has an input connected to interface 200 and an output connected in controlling relation to motor 212. A position sensor or resolver 218 is mechanically connected to the output shaft of motor 212 and provides electrical output signals to bus 200. These signals contain information as to the rotational position of article 40'' about axis 44'', i.e. the $\phi$ values mentioned above. Various switches such as those indicating the home and rest positions are collectively designated 220 and are connected electrically to bus 200. A control 222 for the foil pull-up assembly 180 is connected to bus 200.

A microprocessor 226 having a RAM memory 228 operatively connected thereto is connected to bus 200 and performs the various functions according to the program described in the flow chart of FIGS. 5 and 6. That includes processing the $F_x$,$F_y$, y and $\phi$ signals, performing calculations and providing control signals to drive units 206 and 216. The controls and displays of panel 184 are connected to microprocessor 226.

By way of example, in an illustrative apparatus microprocessor 226 and memory 228 are commercially available as a unit under the designation Delta Tau model PMAC-DSP-PC, A/D converter 196 is Delta Tau model ACC-28, force/torque sensor 190 is commercially available under the designation Interface load cell model 1210XYA, motors 202, 212, resolvers 208, 218 and drive units 206 and 216 are commercially available as a package under the designation GETTYS 3000 Series brushless servo system.

Figure 12:
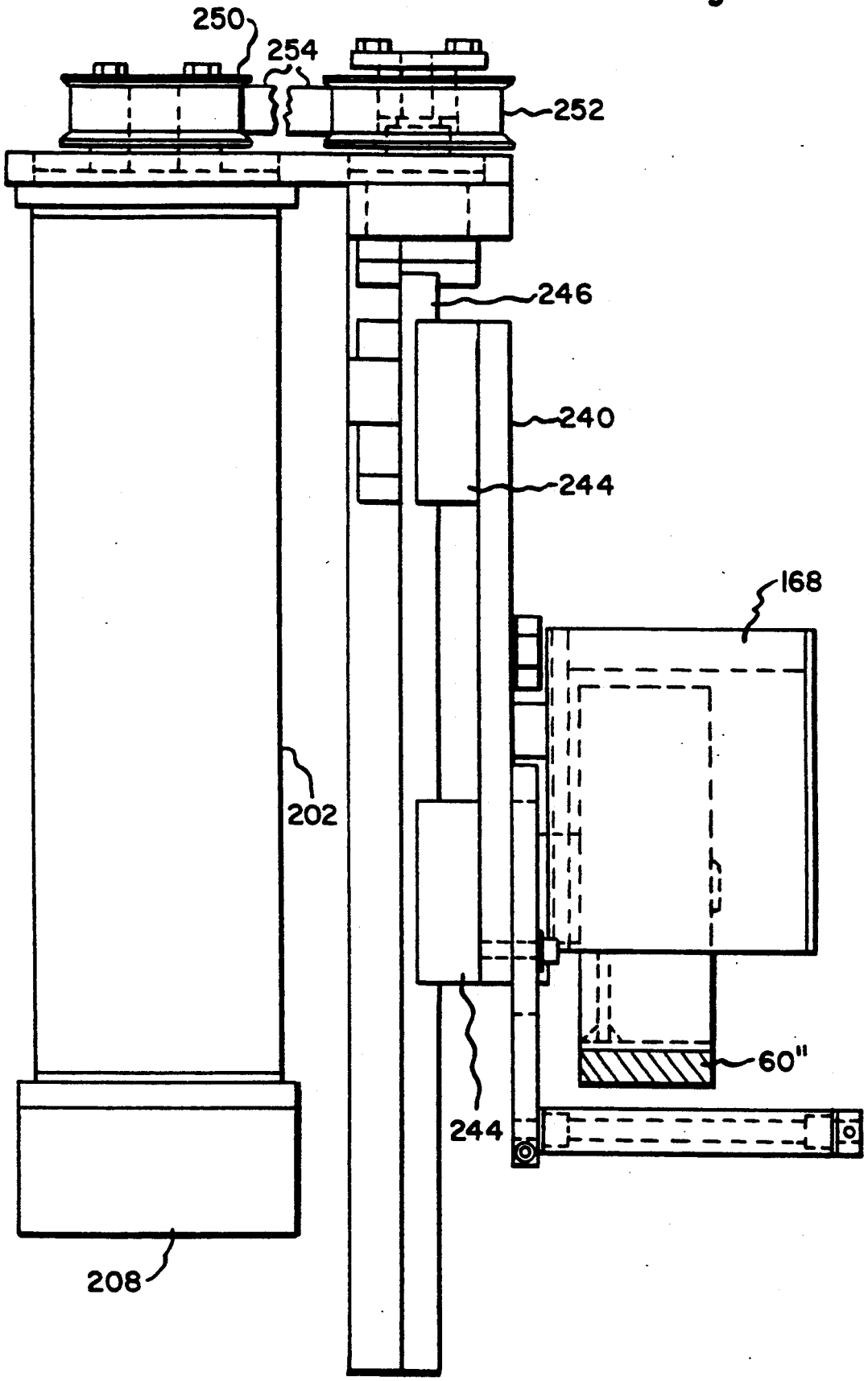
FIG. 12 is an enlarged fragmentary side elevational view of the roller vertical drive subassembly in the apparatus of FIGS. 8–10.
Figure 13:
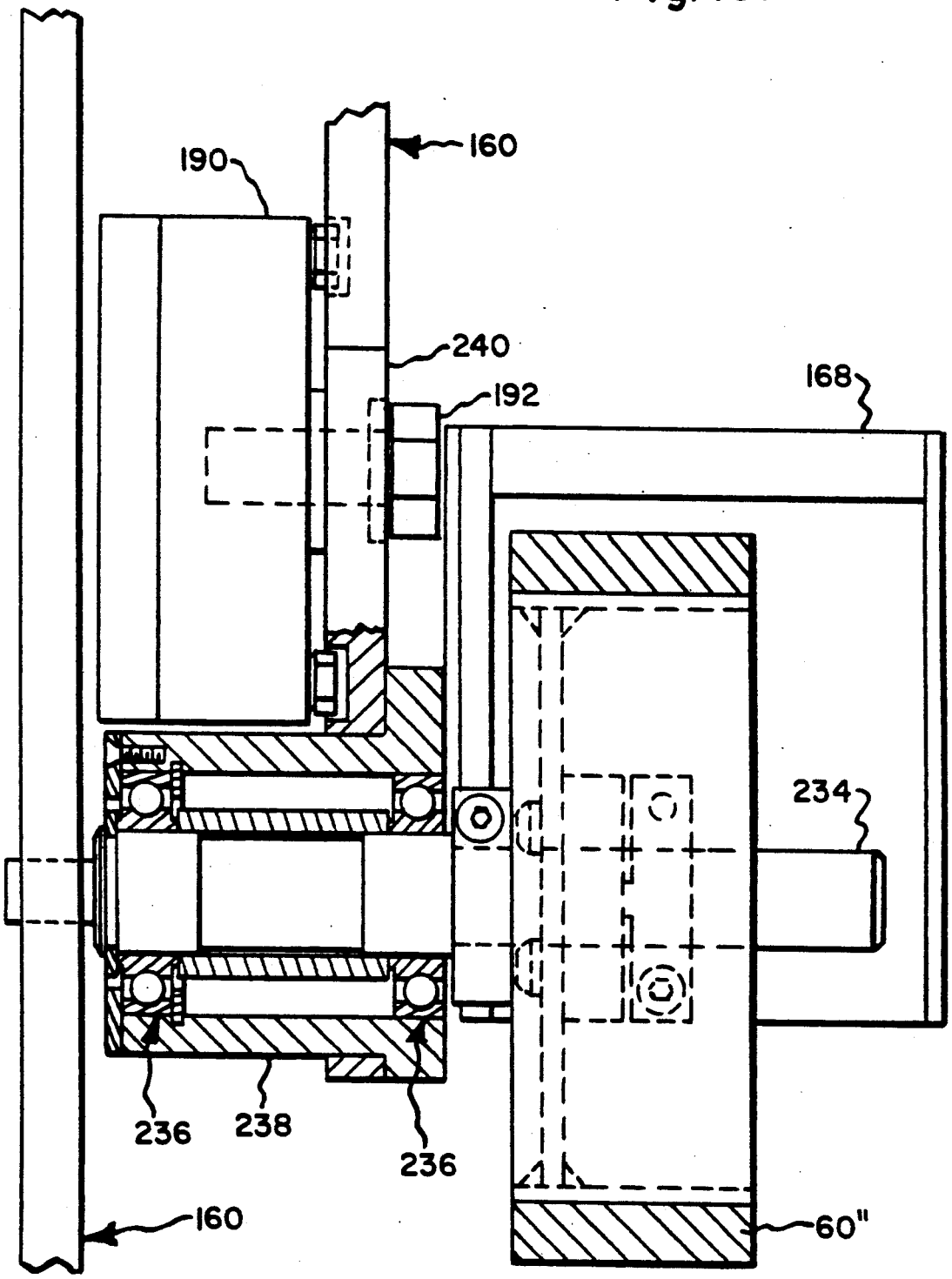
FIG. 13 is an enlarged sectional view of a portion of the sub-assembly of FIG. 12.
Figure 14:
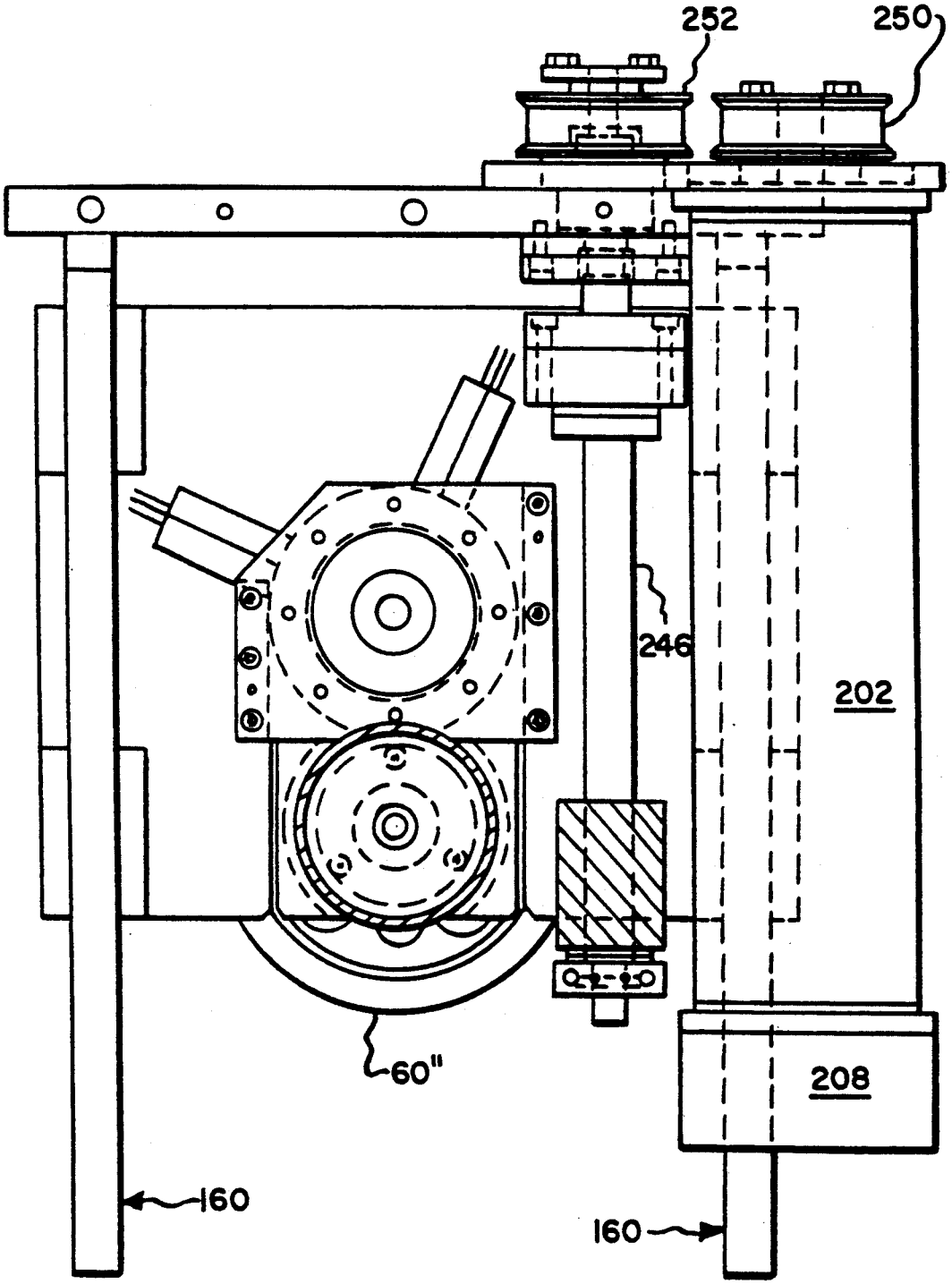
FIG. 14 is a rear elevational view of the sub-assembly of FIG. 12.
Figure 15:
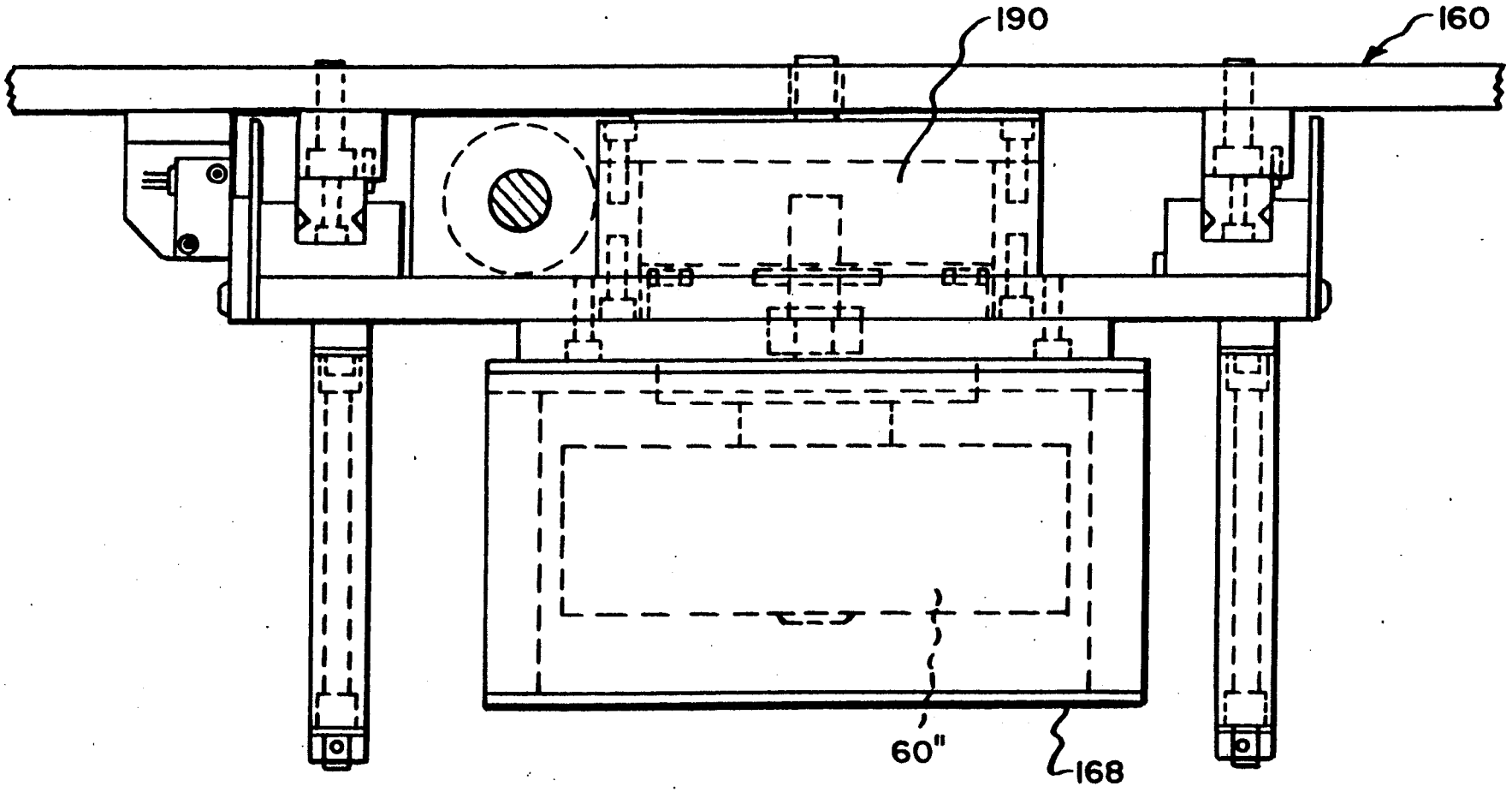
FIG. 15 is a top plan view of the sub-assembly of FIG. 12.

FIGS. 12–15 illustrate in further detail the roller vertical drive sub-assembly 172. As shown in FIG. 13, roller 60'' is fixed to a shaft 234 which is journalled in a bearing assembly 236 housed in a bearing housing 238 which is fixed to a base member 240. Force/torque sensor 190 is in the form of a load cell which is mounted by bolt 192 to base member 240. Thus, forces on in roller shaft 234 are sensed by load cell 190 to provide the $F_x$ and $F_y$ output signals.

Roller 60'', heater assembly 168 associated therewith and load cell 190 are carried as a unit by base member 240. Referring now to FIG. 12, base member 240 has fixed thereto a pair of guides 244 which, in turn, are threadably connected on ball screw 246 which is driven by motor 202 through an arrangement of belt 248 and pulleys 250,252. Thus, operation of motor 202 moves base member 240 vertically as viewed in FIG. 12 to move roller 60'' toward and away from the outer surface of article 40''.

Figures 16A, 16B:
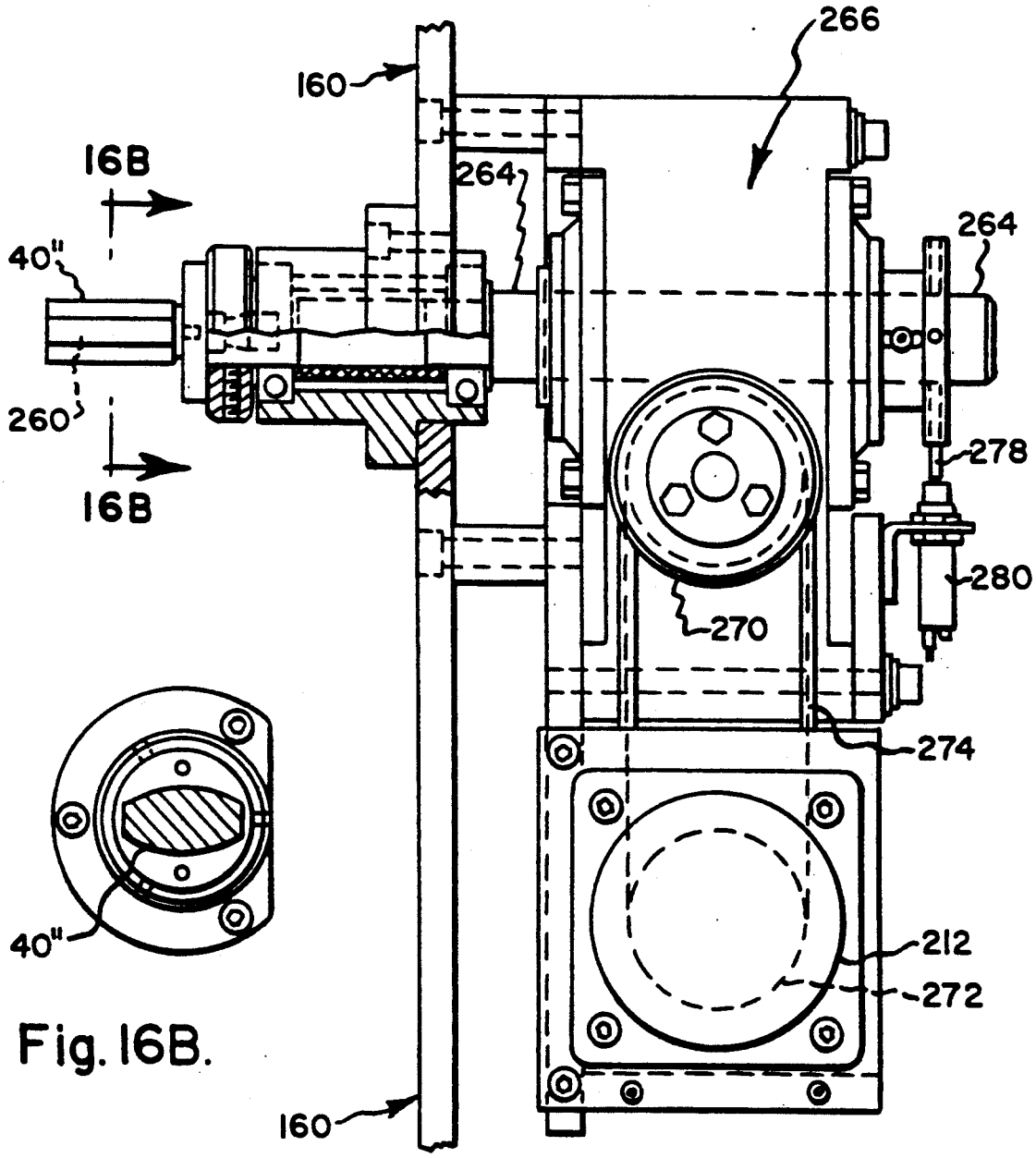
FIG. 16A is an enlarged fragmentary side top plan view of the part rotary drive subassembly in the apparatus of FIGS. 8–10.
FIG. 16B is an elevational view, partly in section, taken about on lines 16B—16B in FIG. 16A.
Figure 17:
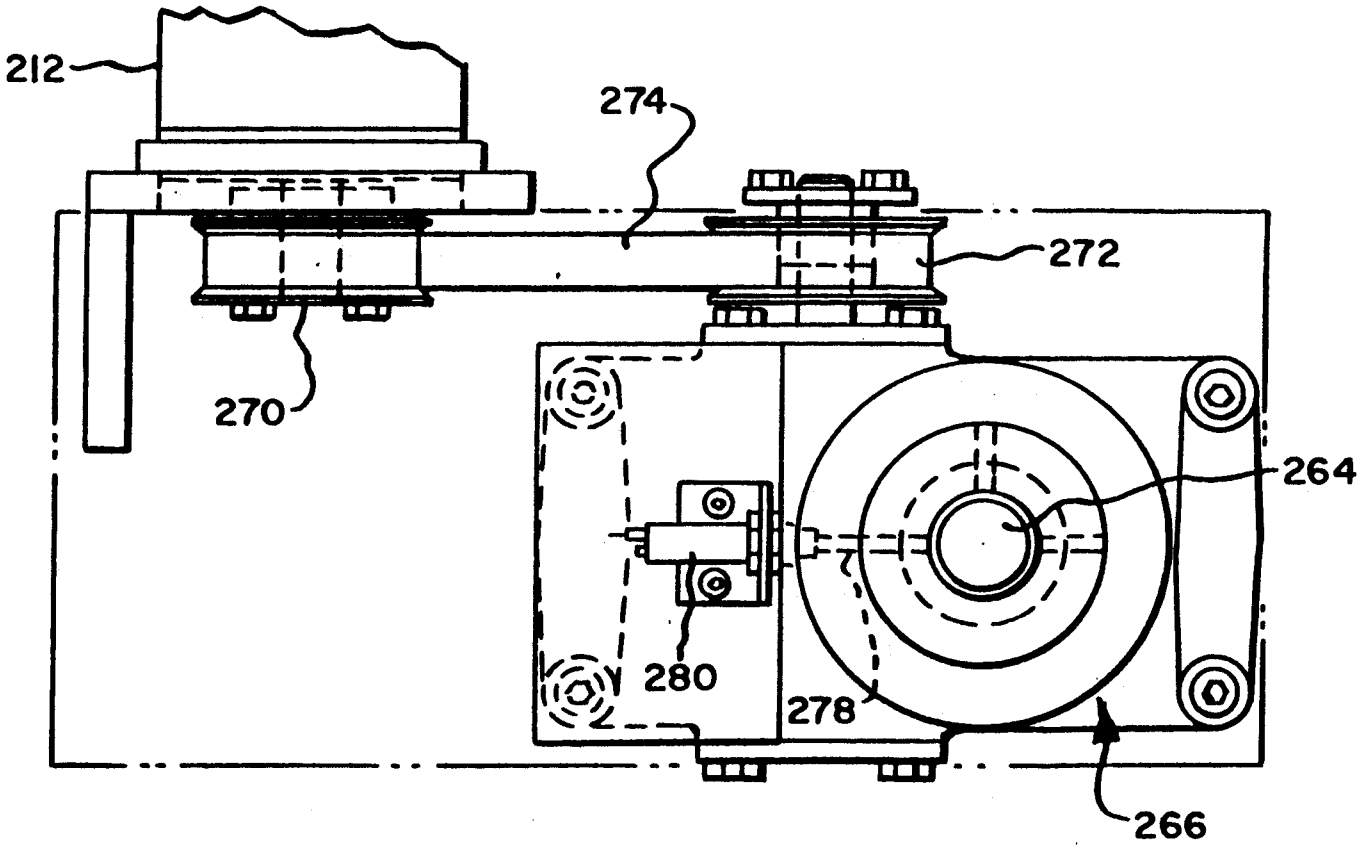
FIG. 17 is a rear elevational view of the subassembly of FIG. 16A.

FIGS. 16 and 17 illustrate in further detail the part rotary drive subassembly. Part 40' is fitted on a nest 260 having an outer surface adapted to snugly fit in the interior surface of part 40''. Next 260 is coupled by an assembly 262 to one end of a shaft 264 of a speed reducer 266 which is driven by motor 212 through an arrangement of pulleys 270,272 and belt 274. The axis of shaft 264 is co-incident with axis 44'' of article 40''. A home position cam 278 is fixed to the other end of shaft 264 and is adapted to register with a proximity switch 280 fixed to the body of speed reducer 266 when shaft 264 is in the home position. Thus, operation of motor 212 rotates article 40'' about its axis 44''.

It is therefore apparent that the present invention accomplishes its intended objects. The method and apparatus of the present invention assures constant pressure and constant linear speed between the article and the decorating medium, and articles of any non-circular shape or cross section can be decorated. During the teaching mode all characteristics and features of the shape of the article are properly recognized, and during the decorating or finishing mode variations in dimensions of articles are compensated for. The same roller which presses the decorating medium on the article surface during the finishing mode is used also during the teaching mode. The method and apparatus of the present invention has the capability of applying a wide variety of decoration, artwork, labelling, text material and the like to the outer surfaces of a myriad of containers, packages and articles of non-circular cross-section.

While an embodiment of the present invention has been described in detail, that has been done for the purpose of illustration, not limitation.

We claim:

1. A method for decorating or finishing the external surface of an article having a non-circular cross-sectional configuration wherein a roller is employed for applying a decorating medium to the article surface, said method comprising the steps of:

a) applying a constant force by means of the roller to the article surface while rotating the article at a constant speed about a fixed axis during a teaching mode to obtain information relating to the shape of the surface; and b) controlling the force applied by the roller to the article surface and the speed of rotation of the article according to a trajectory generated from said information obtained during said teaching mode to provide constant pressure and constant linear speed between the article and the decorating medium during a finishing mode.

2. A method according to claim 1, further including detecting variations in dimensions of successive articles being decorated during the finishing mode and making corrections to maintain proper values of applied force and resulting contact pressure.

3. A method according to claim 1, wherein said finishing mode comprises roll-on hot stamping 4. A method for decorating or finishing the external surface of an article having a non-circular cross-sectional configuration wherein a roller is employed for applying a decorating medium to the article surface, said method comprising the steps of:

a) mounting the article for rotation about a first axis;
b) mounting the roller for free rotation about a second axis and for linear movement along a path joining the first and second axes into contact with the article surface;
c) rotating the article at a constant speed and moving the roller along said path to apply a constant force to the article surface during a teaching mode;
d) detecting changes in a parameter at intervals along the circumference of the article to obtain indications of the radius of the article at said intervals; and
e) controlling the force applied by the roller to the article surface and the speed of rotation of the article according to a trajectory generated from said indications of the radius of the article obtained during said teaching mode to provide constant pressure and constant linear speed between the article and the decorating medium during a finishing mode.

5. A method according to claim 4, wherein said teaching mode includes two cycles or runs at two different levels of applied force, differences in roller deflection are used to provide an indication of the article radius at increments of angular rotation of the article during the finishing mode, and angles of inclination of applied force at each of the angular rotational increments are used for control of the force applied by the roller to the article during the finishing mode.

6. A method according to claim 4, wherein during said finishing mode the trajectory is used to control the speed of rotation of the article to reduce the contact time between the article and the roller at points of sharp curvature along the article to provide constant linear speed between the article and the decorating medium and the force applied by the roller substantially perpendicular to the article surface is varied according to the curvature of the article to provide constant pressure at the point of contact between the article and the roller.

7. A method according to claim 4, further including detecting variations in dimensions of successive articles being decorated during the finishing mode and making correction to maintain proper values of applied force and resulting contact pressure.

8. A method according to claim 4, wherein said finishing mode comprises roll-on hot stamping.

9. In a method for decorating or finishing the external surface of an article having a non-circular cross-sectional configuration wherein a roller is employed for applying a decorating medium to the article and wherein the force applied by the roller is measured during operation thereof:

a) storing values of measured force after a change in stamping parameters during the entire trajectory of motion of the article during a first stamping run; and
b) during subsequent stamping runs utilizing the stored values for comparison to actually measured values during the subsequent runs to provide a control action correcting the position of the roller so that the actually measured value of the force is equal to the second value of the force for all points along the stamping trajectory.

10. Apparatus for decorating or finishing the external surface of an article having a non-circular cross-sectional configuration wherein a roller is employed for applying a decorating medium to the article surface, said apparatus comprising the steps of:

a) means for mounting the article for rotation about a first axis;
b) means for mounting said roller for free rotation about a second axis and for linear movement along a path joining the first and second axes into contact with the article surface;
c) means for rotating said article at a constant speed and moving said roller along said path to apply a constant force to the article surface during a teaching mode;
d) means for detecting changes in a parameter at intervals along the circumference of the article to obtain indications of the radius of the article at said intervals; and
e) means for controlling the force applied by the roller to the article surface and the speed of rotation of the article according to a trajectory generated from said indications of the radius of the article obtained during said teaching mode to provide constant pressure and constant linear speed between the article and the decorating medium during a finishing mode.

11. Apparatus according to claim 10, further including means for detecting variations in dimensions of successive articles being decorated during the finishing mode and for making corrections to maintain proper values of applied force and resulting contact pressure.

12. Apparatus according to claim 10, comprising roll-on hot stamping apparatus.

13. Apparatus for decorating an article by roll-on hot stamping comprising:

a) means for rotating an article to be decorated about a first axis;
b) means for mounting a roller for free rotation about a second axis substantially parallel to the axis of the article to be decorated;
c) linear positioning means for positioning said roller relative to a second home position and relative to the surface of the article to be decorated;
d) first measurement means for measuring force acting between a roller and the article to be decorated during a teaching mode and during a subsequent stamping mode;
e) second measurement means for measuring the rotary position of said article about said first axis and relative to a first home position;
f) third measurement means for measuring the linear position of said roller relative to said second home position; and
g) information processing means for receiving data from said first, second and third measurement means and for providing control signals to said rotating means and to said positioning means;
h) so that during said teaching mode there is a first run in which said article to be decorated is rotated with a defined speed while said roller is moved by said positioning means under feedback control from the resultant force measured by said first measurement means, said feedback control controlling said roller positioning means so that the force acting between said roller and said article is constant and equal to a predetermined set value, linear positions of the roller and an inclination of the force corresponding to defined increments of rotary motion being stored by said information processing means for the entire circumference of the article to be decorated, there being a second run during the teaching mode similar to the first run but utilizing a different force, and data gathered in said two runs being used by said information processing means to calculate a trajectory in motion for use during the hot stamping mode.

14. Apparatus according to claim 13, further including means responsive to each change of stamping parameters for causing values of force measured by said first measuring means to be stored by said information processing means for the entire trajectory of the hot stamping so that in subsequent stamping runs the stored values are used as set values for control using actually measured force, the differences between the stored set values and actual values of force providing a control action to correct the position of the roller in such direction to have actually measured values of the force equal to the relevant stored set values for all points of the stamping trajectory.

* * * * *